US006481180B1

(12) United States Patent
Takahashi et al.

(10) Patent No.: US 6,481,180 B1
(45) Date of Patent: Nov. 19, 2002

(54) SOLID PREPARATION FILLING APPARATUS

(75) Inventors: Hideyuki Takahashi, Gunma (JP); Hitoshi Ishiwatari, Gunma (JP); Manabu Haraguchi, Gunma (JP); Toshihiko Ota, Gunma (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/571,551

(22) Filed: May 16, 2000

(30) Foreign Application Priority Data

May 20, 1999 (JP) ..... 11-140462
Nov. 9, 1999 (JP) ..... 11-318912

(51) Int. Cl.[7] ..... B65B 1/04

(52) U.S. Cl. ..... 53/237; 53/238; 53/247; 221/133

(58) Field of Search ..... 53/154, 237, 247, 53/493, 238; 221/130, 133

(56) References Cited

U.S. PATENT DOCUMENTS 5,348,061 A * 9/1994 Riley et al. ..... 221/133
5,481,855 A 1/1996 Yuyama ..... 53/493
5,667,096 A * 9/1997 Wu ..... 221/133
5,678,393 A * 10/1997 Yuyama et al. ..... 53/237
5,709,063 A * 1/1998 Yuyama et al. ..... 53/154
5,752,368 A * 5/1998 Tobe ..... 53/237
5,787,678 A * 8/1998 Koike et al. ..... 53/154
5,852,911 A * 12/1998 Yuyama et al. ..... 53/154
5,865,342 A * 2/1999 Ito et al. ..... 221/265
6,170,699 B1 * 1/2001 Kim ..... 221/253
6,208,911 B1 * 3/2001 Yamaoka et al. ..... 221/2

FOREIGN PATENT DOCUMENTS

EP 0 850 633 A2 1/1998
JP 03162204 12/1991
JP 10-192367 * 7/1998

* cited by examiner

*Primary Examiner*—John Sipos
*Assistant Examiner*—Louis Huynh
(74) *Attorney, Agent, or Firm*—Darby & Darby

(57) ABSTRACT

A solid preparation filling apparatus for filling solid preparations such as tablets into a container and avoiding mixture with any other preparation. Each type of solid preparation is to be ejected from its respective tablet case, and the upper end inlet of a holding cell is associated with the discharge port of a hopper that receives the ejected solid preparation from the tablet case by rotating and moving the holding cells to adjust their positions so that the solid preparation falling from a tablet case is accommodated in a predetermined holding cell. When filling the solid preparation in a container, the holding cell is rotated and moved so that its outlet is matched with a chute and the holding cell shutter is opened. The holding cell and the shutter constitute a holding unit, and a plurality of holding units are mounted on the rotating plate which rotates under the hopper.

7 Claims, 38 Drawing Sheets

SOLID PREPARATION FILLING APPARATUS

BACKGROUND OF THE INVENTION

Field of the Invention

The present invention relates to a solid preparation filling apparatus for filling a solid preparation (the solid preparation indicates all the hardened preparations such as a tablet, a capsule, a pill, a troche and others hereinafter) designated by a prescription in a hospital and the like.

In a hospital and the like, a tablet packing machine such as disclosed in, e.g., Japanese Patent Application Laid-Open No. 59-1991 (A61J3/00) has been conventionally used in order to pack multiple kinds of tablets prescribed by a medical physician for each dosage to be provided to a patient. However, since this packing system ejects the tablets for each dosage and collects them by using a hopper or a conveyer for package, it requires a long period of time including a waiting time for collecting the tablets until the packaging is completed. Further, the tablets are collected exclusively dependent upon the gravitational force by using such a hopper or a conveyer, which results in increase in size of the apparatus.

On the other hand, there is also a tablet filling apparatus which fills the prescribed tablets in a container such as a bottle (or a bag) in accordance with each type of the tablets so that they are provided to a patient. In case of this tablet filling apparatus, a plurality of tablet cases each of which contains therein the tablets in accordance with each type are deeply inclined forward and arranged in the form of a locker; an ejection mechanism for ejecting the tablets in the tablet case is provided in each tablet case; and the tablets in the tablet case designated based on a prescription are ejected by each ejection mechanism.

In such a tablet filling apparatus, since the tablets are not packed in accordance with each dosage, the tablets can be filled in a shorter period of time than the above-described tablet packing machine. However, this apparatus requires such an operation as that an operator goes to a front of the tablet case with a container in his/her hand and fills the tablets in the container from the ejection mechanism, and hence the operation for filling the tablets in respective types of containers becomes extremely complicated if a number of types of the tablets is large, thereby taking much time.

In addition, since the plural tablet cases are arranged on a wall in the form of a locker, downsizing of the overall apparatus which has been demanded in the prior art tablet packing machine can not be achieved.

Thus, as disclosed in, e.g., Japanese Patent Application Laid-Open No. 192367/1998, the present applicant has developed a structure in which a rotating plate is provided on the lower side of a plurality of aligned tablet cases, a plurality of storage partitions being formed to the rotating plate, tablets ejected from a tablet case being put in a corresponding predetermined storage partition under the tablet case by rotation of the rotating plate, the tablets being reserved and filled from a discharge port into a container.

According to such a structure, the tablets can be filled at one position, and the vertical dimension of the entire apparatus can be minimized as compared with the conventional conveyer type or locker type apparatus. However, since the rotating plate rotates, the tablets are caused to jump in another storage partition from a clearance (gap) formed around the rotating plate, which disadvantageously generate mixture of a different type of medicine.

In order to avoid this, the clearance between the rotating plate and a member therearound must be strictly defined for design/manufacture, resulting in a problem such that the productivity is deteriorated and the cost is increased.

SUMMARY OF THE INVENTION

In order to eliminate the above-described drawbacks in the prior art, in a solid preparation filling apparatus for filling a solid preparation such as a tablet in a predetermined container, it is an object of the present invention to maintain minimization of the apparatus, simplify the structure thereof, assuredly prevent mixture of another preparation and improve the assembling work property.

The solid preparation filling apparatus according to the present invention includes: a plurality of tablet cases for accommodating therein solid preparations in accordance with each type; a plurality of hoppers which are aligned under each tablet case in the corresponding manner and receive the solid preparations ejected from each tablet case; a discharge port formed at a lowermost portion of each hopper; a plurality of holding cells which are arranged under these hoppers and rotated and moved on a circumference where the discharge port of each hopper is presented; a shutter for opening/closing a lower end outlet of the holding cell; a guide portion for guiding the solid preparations into a predetermined container; and a control device for ejecting the solid preparations from the tablet case accommodating therein a designated type of solid preparation based on predetermined prescription data, wherein the control device associates the upper end inlet of the holding cell with the discharge port of the hopper which receives the ejected solid preparation to accommodate the solid preparations falling from the tablet case in a predetermined holding cell by rotating and moving the holding cell to adjust its position when ejecting the solid preparations from the tablet case, and the holding cell is rotated and moved so that the outlet thereof is matched with the guide portion when filling in the container, thereby opening the shutter.

Further, in the solid preparation filling apparatus according to the present invention, the shutter opens/closes an inlet of the guide portion.

Additionally, in the solid preparation filling apparatus according to the present invention, a cover which can be opened/closed without restraint is provided at an outlet of the guide portion.

Furthermore, the solid preparation filling apparatus according to the present invention includes: a plurality of tablet cases for accommodating therein solid preparations in accordance with each type; a plurality of hoppers which are aligned under each tablet case in the corresponding manner and receive the solid preparations ejected from each tablet case; a discharge port formed at a lowermost portion of each hopper; and a plurality of holding cells which are arranged under these hoppers and rotated/moved on a circumference where the discharge port of the hopper is presented; a shutter for opening/closing the lower end outlet of the holding cell; and filling means which guides and fills the solid preparations ejected from the holding cell to a predetermined container, wherein the upper end inlet of the holding cell is associated with the discharge port of the hopper for receiving the ejected solid preparations to accommodate the solid preparations falling from the tablet case in a predetermined holding cell by rotating and moving the holding cell to adjust its position when ejecting the solid preparations from the tablet case, and the holding cell is rotated and moved so that its outlet is matched with the filling means to open the shutter when filling in the container, the holding cell and the shutter constituting a holding unit, a plurality of holding units being disposed on the rotating plate which rotates under the hoppers.

Additionally, in the solid preparation filling apparatus according to the present invention, shutter driving means for opening/closing the shutter is arranged in such a manner that the holding cell can be detachably engaged with the shutter of the holding unit matched with the filling means without interfering the rotation and movement of the holding unit caused by rotation of the rotating plate.

Moreover, in the solid preparation according to the present invention, shutter opening/closing detecting means for detecting opening/closing of the shutter is provided in addition to the above.

DETAILED DESCRIPTION OF THE PREFERRED EMBODIMENTS

Figure 1:
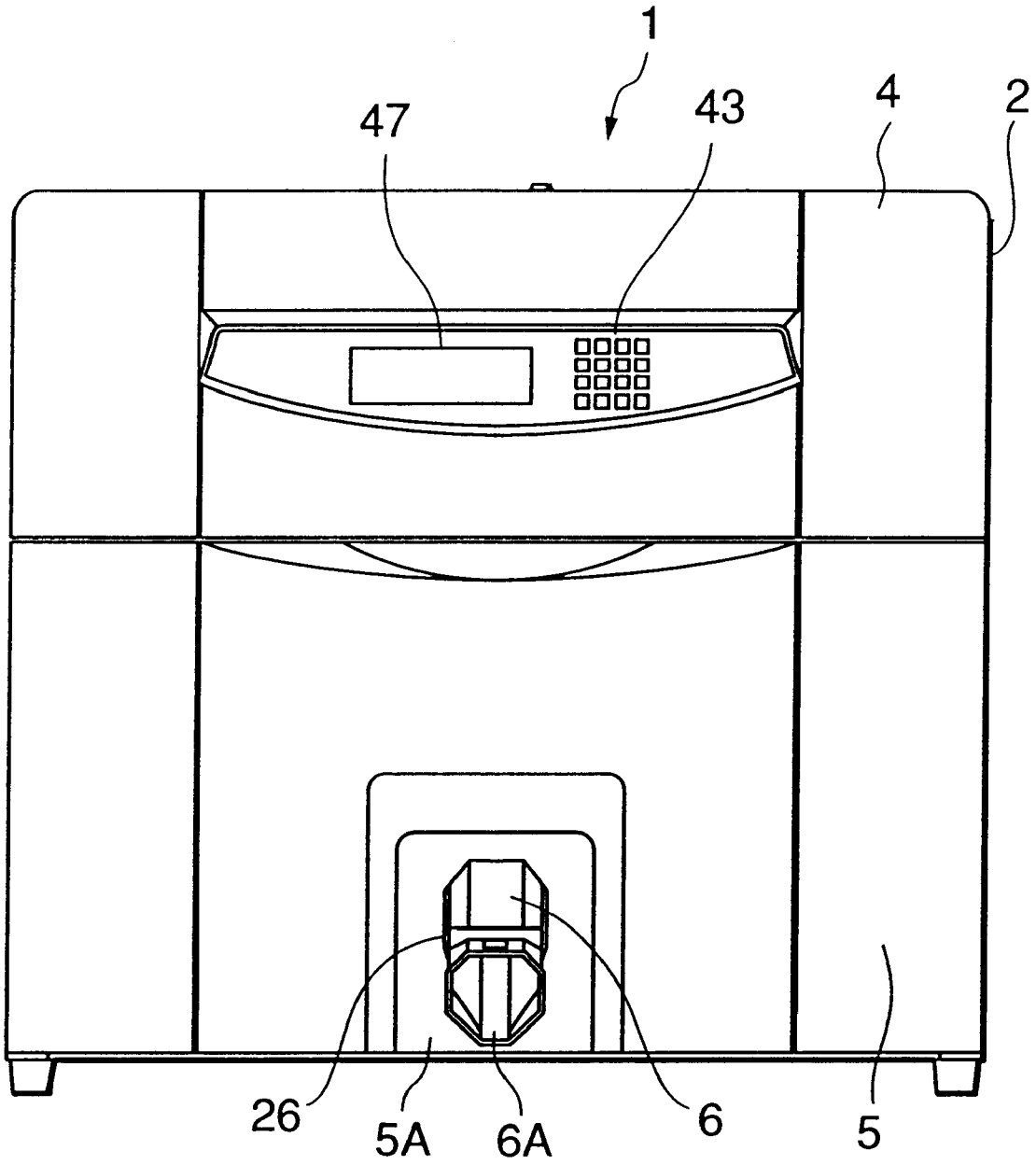
FIG. 1 is a front view showing a solid preparation filling apparatus according to the present invention.
Figure 2:
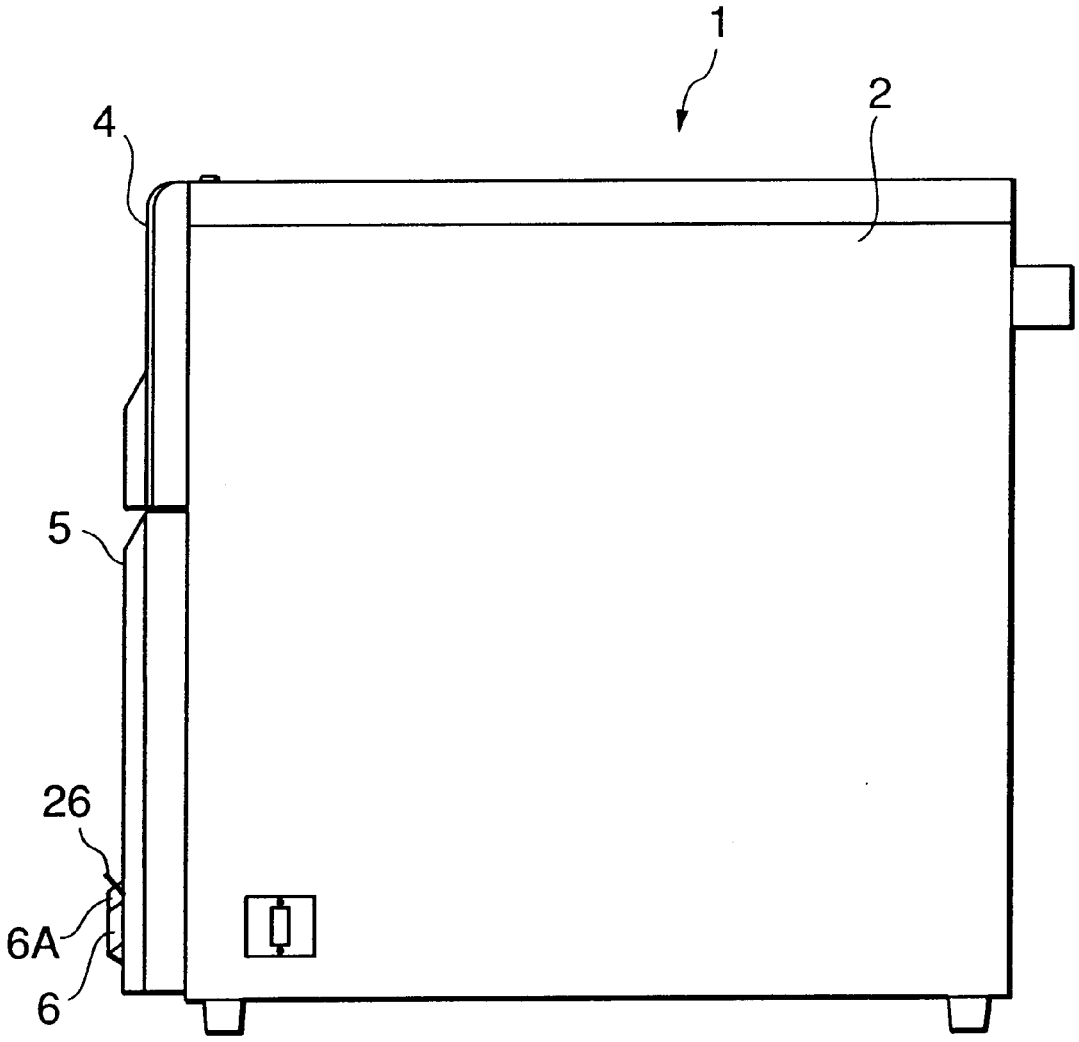
FIG. 2 is a side view showing the solid preparation filling apparatus according to the present invention.
Figure 3:
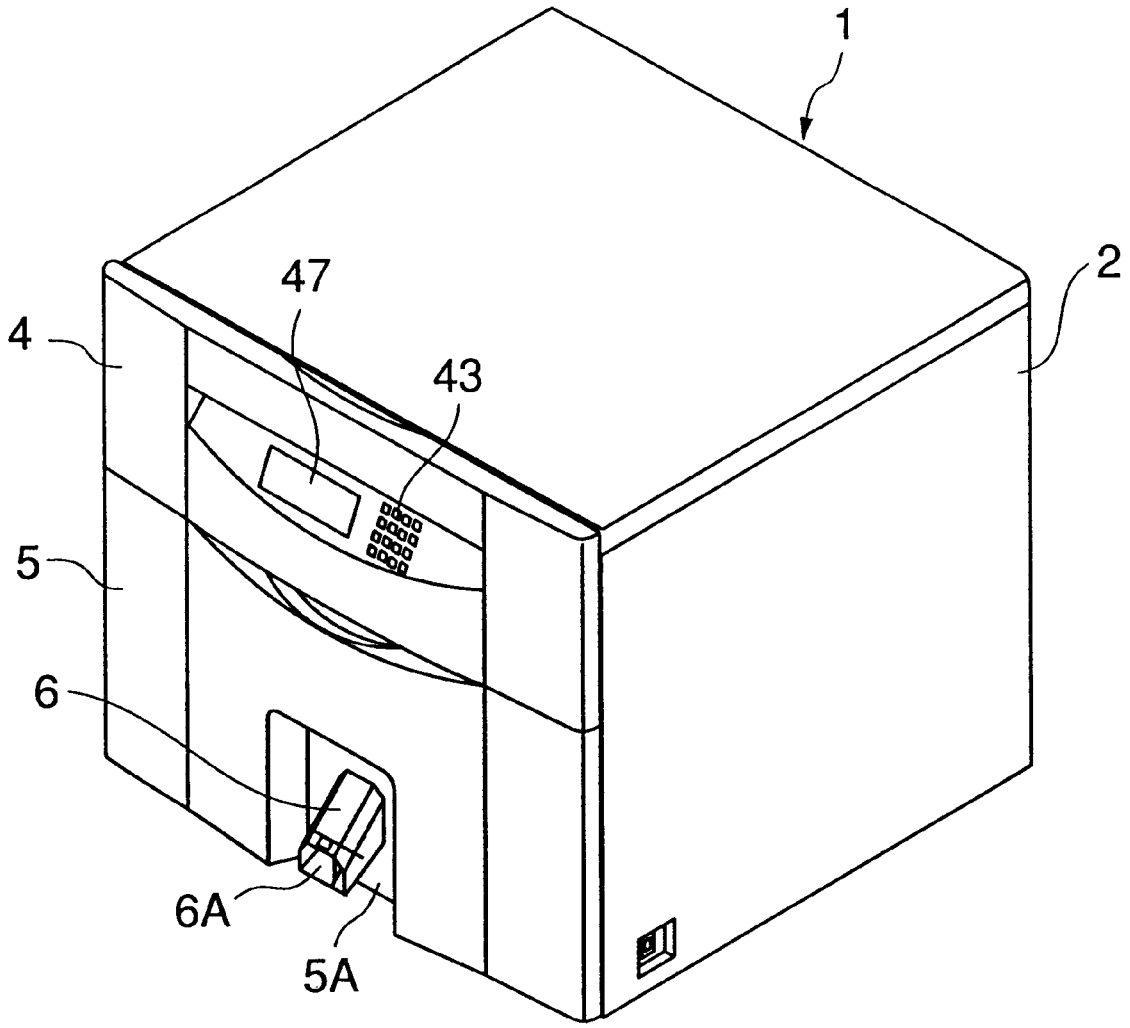
FIG. 3 is a perspective view showing the solid preparation filling apparatus according to the present invention.
Figure 4:
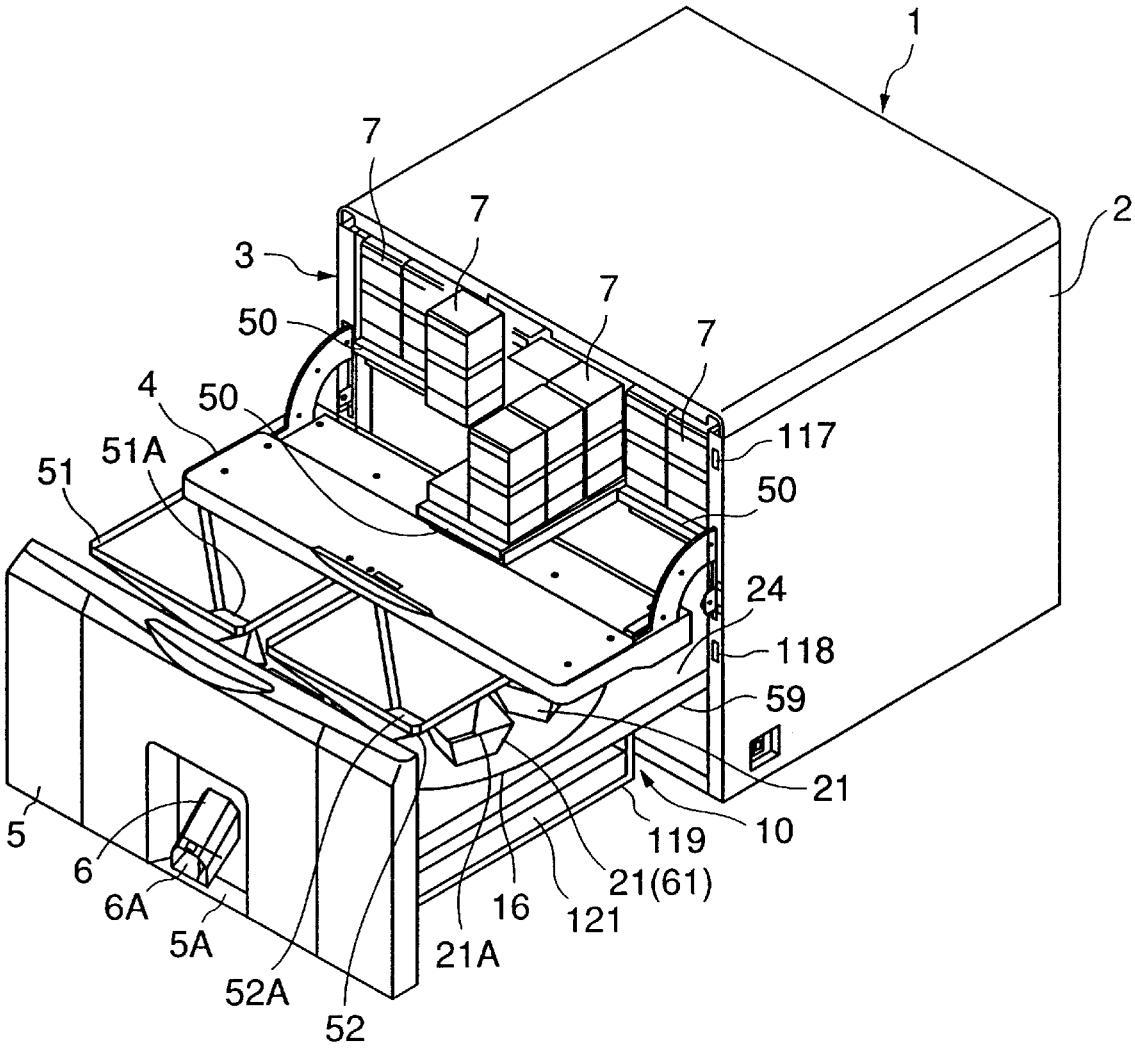
FIG. 4 is a perspective view showing the state where upper and lower doors of the solid preparation filling apparatus according to the present invention are opened.
Figure 5:
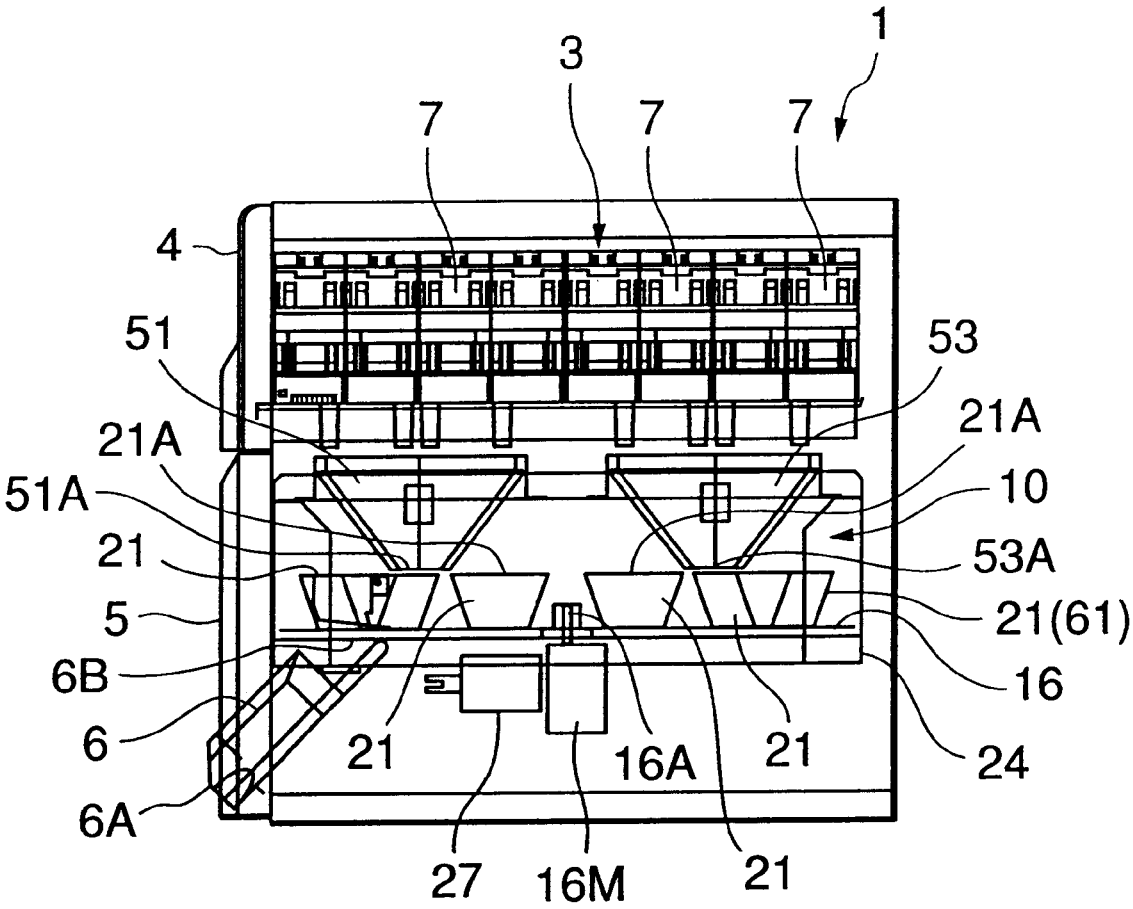
FIG. 5 is a longitudinal side view of the solid preparation filling apparatus according to the present invention.

The preferred embodiments according to the present invention will now be described with reference to the accompanying drawings. FIG. 1 is a front view showing a solid preparation filling apparatus 1 according to the present invention; FIG. 2, a side view of the solid preparation filling apparatus 1; FIG. 3, a perspective view of the solid preparation filling apparatus 1; FIG. 4, another perspective view showing the solid preparation filling apparatus 1; FIG. 5, a longitudinal side view showing the solid preparation filling apparatus 1; and FIG. 6, a plan sectional view showing the solid preparation filling apparatus 1, for illustrating the internal structure of the solid preparation filling apparatus 1.

A solid preparation filling apparatus 1 according to the present invention is installed in a hospital or a dispensation pharmacy and constituted by a solid preparation accommodating portion 3 formed in a rectangular main body 2, a solid preparation filling mechanism 10 provided below the portion 3, and others. The solid preparation accommodating portion 3 is formed in the upper portion within the main body 2, and the front face of the solid preparation accommodating portion 3 is closed so as to be opened/closed without restraint by an upper door 4 which can swivel at the front lower portion. Further, the front face of the solid preparation filling mechanism 10 is closed so as to be capable of being opened/closed by a lower door 5 which can be pulled (drawer type) on a rail 59 without restraint. The solid preparation filling mechanism 10 can be pulled out together with the lower door 5 from the inside of the main body 2.

A filling portion 5A inwardly retreating to some extent is formed in the central portion of the front face of the lower door 5, and an outlet 6A of a shoot 6 is opened as a guide portion constituting filling means within the filling portion 5A. Further, a later-described bar code reader 42 is provided within the filling portion 5A at a position in the vicinity of the outlet 6A, and a key switch 43 composed of a ten-key keypad and a display device 47 for displaying a dispensation status such as the content of prescription data or an alarm are disposed on the front face of the upper door 4 corresponding to the upper portion of the filling portion 5A.

On the other hand, a plurality of tablet cases 7 are housed in the solid preparation accommodating portion 3. A predetermined amount of solid preparations is accommodated in each tablet case 7 in accordance with each type, and an ejection count device 8 is provided under each tablet case 7 as shown in FIG. 36.

This ejection count device 8 communicates with the tablet case 7 on the upper side and a motor-driven ejection drum 9 is included in each ejection count device 8. A plurality of grooves 11 are vertically formed on the side surface of the ejection drum 9, and the solid preparation which is a hardened preparation such as the tablet, the capsule, the pill, the troche and others enters each groove 11 in a vertical line (two in this embodiment).

Figure 36:
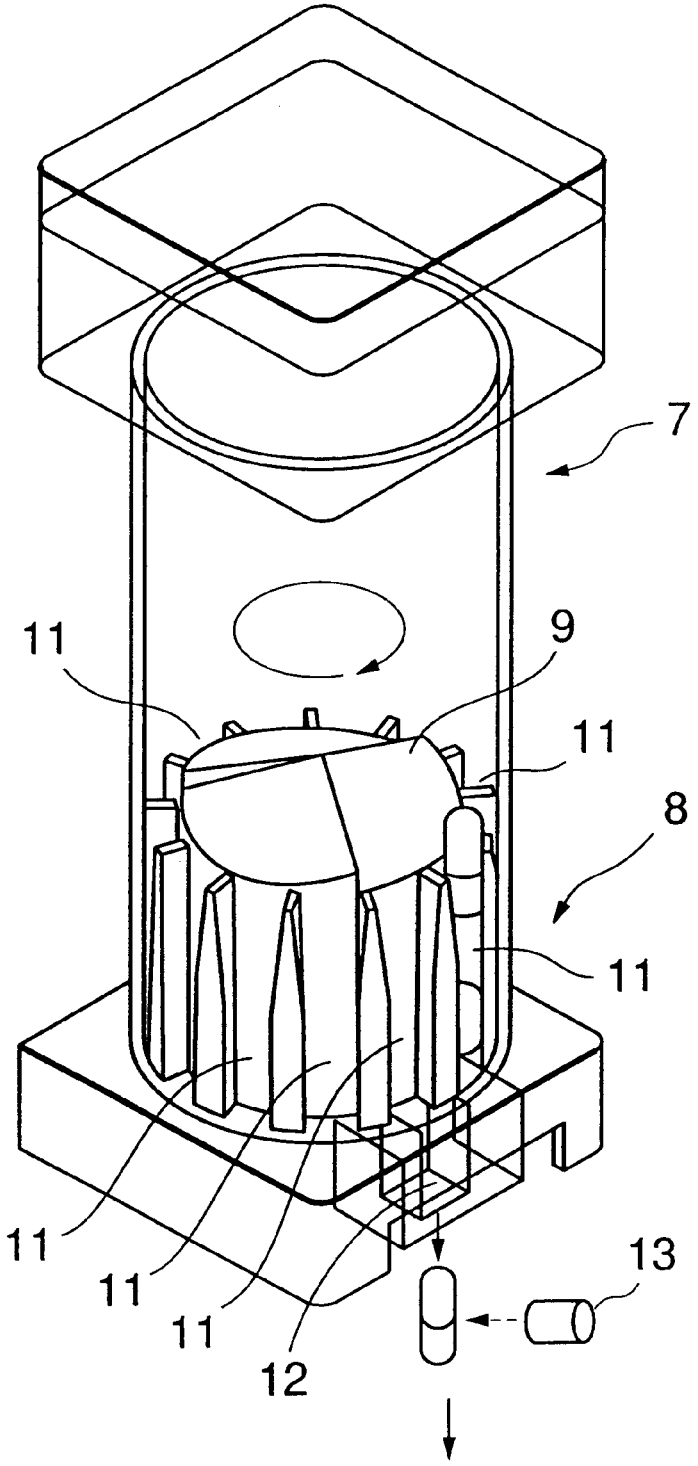
FIG. 36 is a perspective view showing a tablet case and an ejection count device of the solid preparation filling apparatus according to the present invention.

Each one solid preparation in each groove 11 falls from the outlet 12 as the ejection drum 9 rotates (indicated by a black ink arrow in FIG. 36). Further, a photo sensor 13 for detecting the solid preparation falling from the outlet 12 is disposed to the ejection count device 8.

A predetermined number of the above-described tablet cases 7 are mounted on a rectangular bearing member 50, and the multiple bearing members 50 are aligned. In addition, the respective bearing members 50 are held by a non-illustrated rail so as to be capable of being pulled out in the front-and-back direction (see FIG. 4).

When filling the solid preparation in each tablet case 7, the upper door 4 is opened and the bearing member 50 is pulled out so that the tablet cases 7 are moved on the upper door 4. After filling the solid preparation in the tablet cases 7, the bearing member 50 is pushed to the original position to return the tablet cases 7 in the solid preparation accommodating portion 3.

In this manner, when the tablet cases 7 are pulled out in the front-and-back direction, the solid preparation can be filled in the tablet cases 7 or the tablet case 7 itself can be replaced without assuring the space in the upper portion of the solid preparation filling apparatus 1, thereby reducing the required space.

On the other hand, aligned hoppers 51, 52, 53 and 54 whose number is four in this embodiment, a discoid rotating plate 16 having a plurality of (10 in this embodiment) holding units 61 (constituting the filling means) disposed thereon, the above-mentioned shoot 6 and others constitute the solid preparation filling mechanism 10, and the respective hoppers 51 to 54 are provided under the tablet cases 7 without forming any gap therebetween, the rotating plate 16 being rotatably provided on the lower side of the hoppers 51 to 54.

Figure 6:
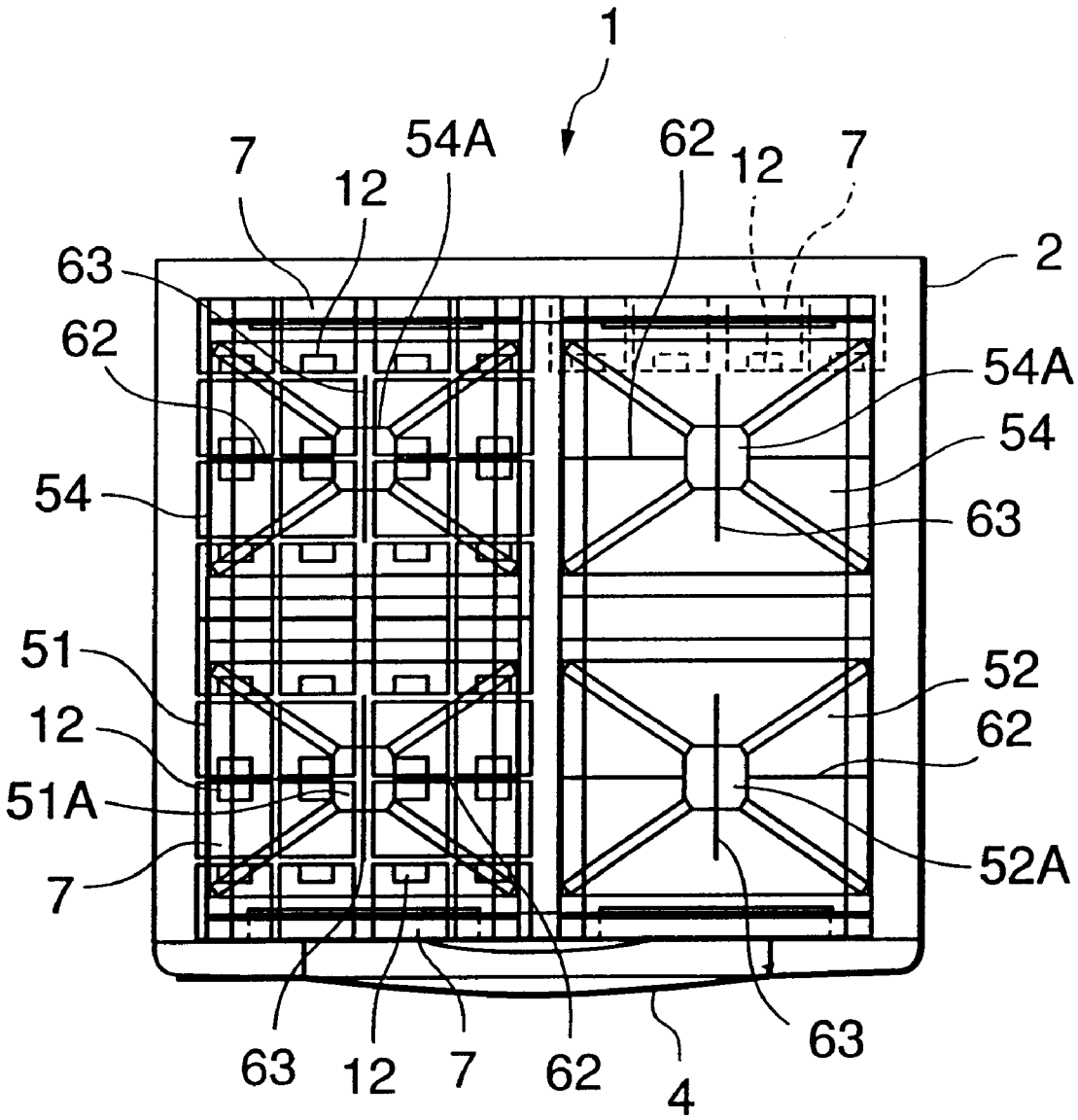
FIG. 6 is a plan sectional view of the solid preparation filling apparatus according to the present invention.
Figure 7:
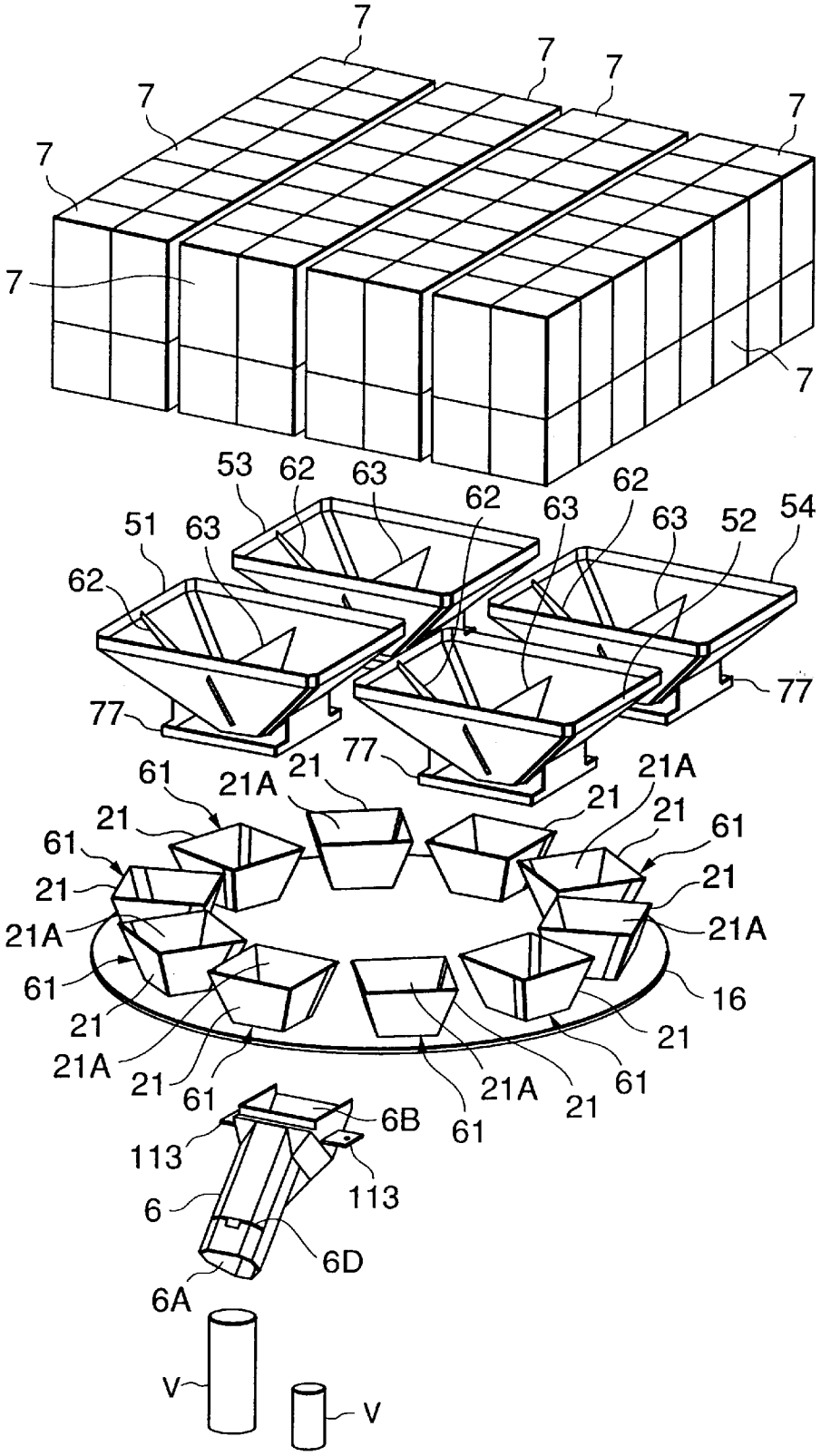
FIG. 7 is a view showing the internal structure of the solid preparation filling apparatus according to the present invention.

In such a case, the respective tablet cases 7 are arranged in the substantially quadrate form on a plane as shown in FIG. 6 and the rotational center 16A of the rotating plate 16 corresponds to the center of this quadrate. Further, each of the hoppers 51 to 54 has a shape such that it is tapered while being inclined from the rectangular upper end openings toward the lower end discharge ports 51A to 54A at a predetermined angle, and this inclination corresponds to a value allowing the successful falling of the solid preparation.

Further, the hoppers 51 and 52 are aligned in the horizontal direction on the front side, while the hoppers 53 and 54 are aligned in the horizontal direction on the rear side, the upper end openings of the respective hoppers 51 to 54 being in close contact with each other without forming any gap therebetween. Of the tablet cases 7 arranged in the square form as a whole, 16 tablet cases in total positioned at the front left portion correspond to the upper portion of the hopper 51 at the front left portion, and 16 tablet cases in total position at the front right portion correspond to the upper portion of the front right hoper 52.

Further, 16 tablet cases 7 in total positioned at the rear left portion correspond to the upper portion of the hopper 53 on the rear left side, and 16 tablet cases in total positioned at the rear right portion correspond to the upper portion of the hopper 54 on the rear left side (see FIG. 6).

With such a structure, if the same solid preparations which are consumed in volume are put in two or more tablet cases 7 corresponding to the upper portion of the same hopper 51, 52, 53 or 54 in advance for example, the solid preparations can be caused to simultaneously fall from these tablet cases 7 to enable filling in a bottle as will be described later, which shortens the filling time.

Moreover, when the tablet cases 7 having the same kind of solid preparation therein are arranged at the upper portion of the same hopper 51, 52, 53 or 54, one hopper can be used exclusively for the same type of solid preparation, thereby eliminating occurrence of inconvenience due to adhesion of the power of a completely different solid preparation to the hopper.

Figure 8:
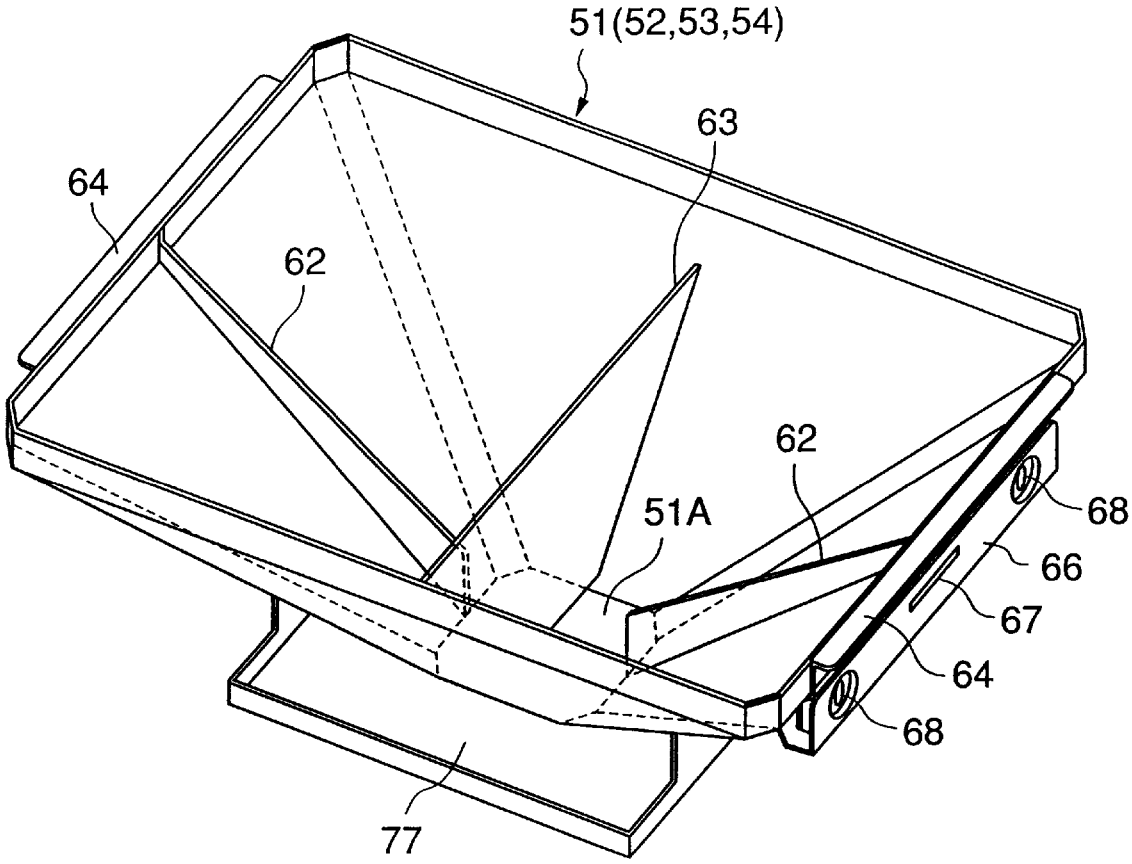
FIG. 8 is a perspective view showing a hopper of the solid preparation filling apparatus according to the present invention.

Here, vertical walls 62 are formed along the horizontal inner surface (inclined surface) of each of the hoppers 51 to 54 as shown in FIG. 8 (description will be given on the hopper 51, but this is also applied to the other hoppers 52 to 54), and a vertical wall 63 is erected along the inner surface in the front-and-back direction so as to stride over the discharge port 51A (52A, 53A, 54A). It is to be noted that these vertical walls 62 and 63 are positioned at portions which are not directly below the outlets 12 of the respective tablet cases 7 as shown in FIG. 6. The solid preparation falling from the tablet cases 7 into the hoppers 51 to 54 caroms on the inner surfaces and tries to repeat this movement, but since the vertical walls 62 and 63 are formed on the inner surfaces of the hoppers 51 to 54, the bounced solid preparation collides with the vertical walls 62 and 63. The rebound movement of the solid preparation is therefore terminated in the early stage and the solid preparation is led to the discharge ports 51A to 54B.

Attaching plates 64 are disposed to each of the hoppers 51 to 54 on the right and left sides of the upper peripheral edges, and a substantially-L-shaped holding plate 66 constituting a high adjusting mechanism is disposed to the lower portion of the attaching plate 64 by non-illustrated screws. In such a case, a slit type engagement hole 67 is formed in the central portion of the holding plate 66, and a longitudinal oval holes 68 are formed to the holding plate 66 on the both sides of the engagement hole 67. Although the screws are engaged with the oval holes 68 and a non-illustrated screw hole of the attaching plate 64, the height of the lower edge of the holding plate 66 can be adjusted by controlling the vertical position of the holding plate relative to the screw hole in a vertical dimension range of the oval holes 68.

Figure 11:
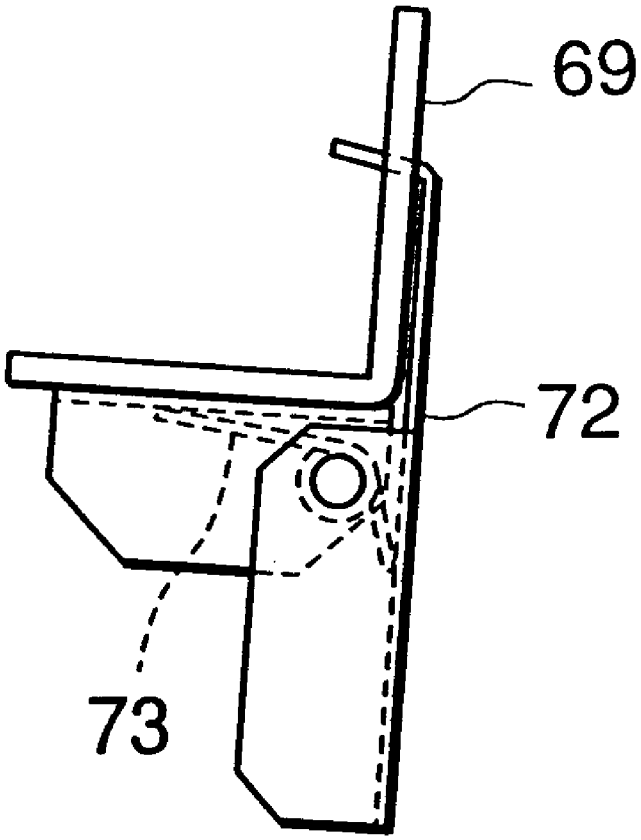
FIG. 11 is an enlarged view of a movable hook of the solid preparation filling apparatus according to the present invention.
Figure 12:
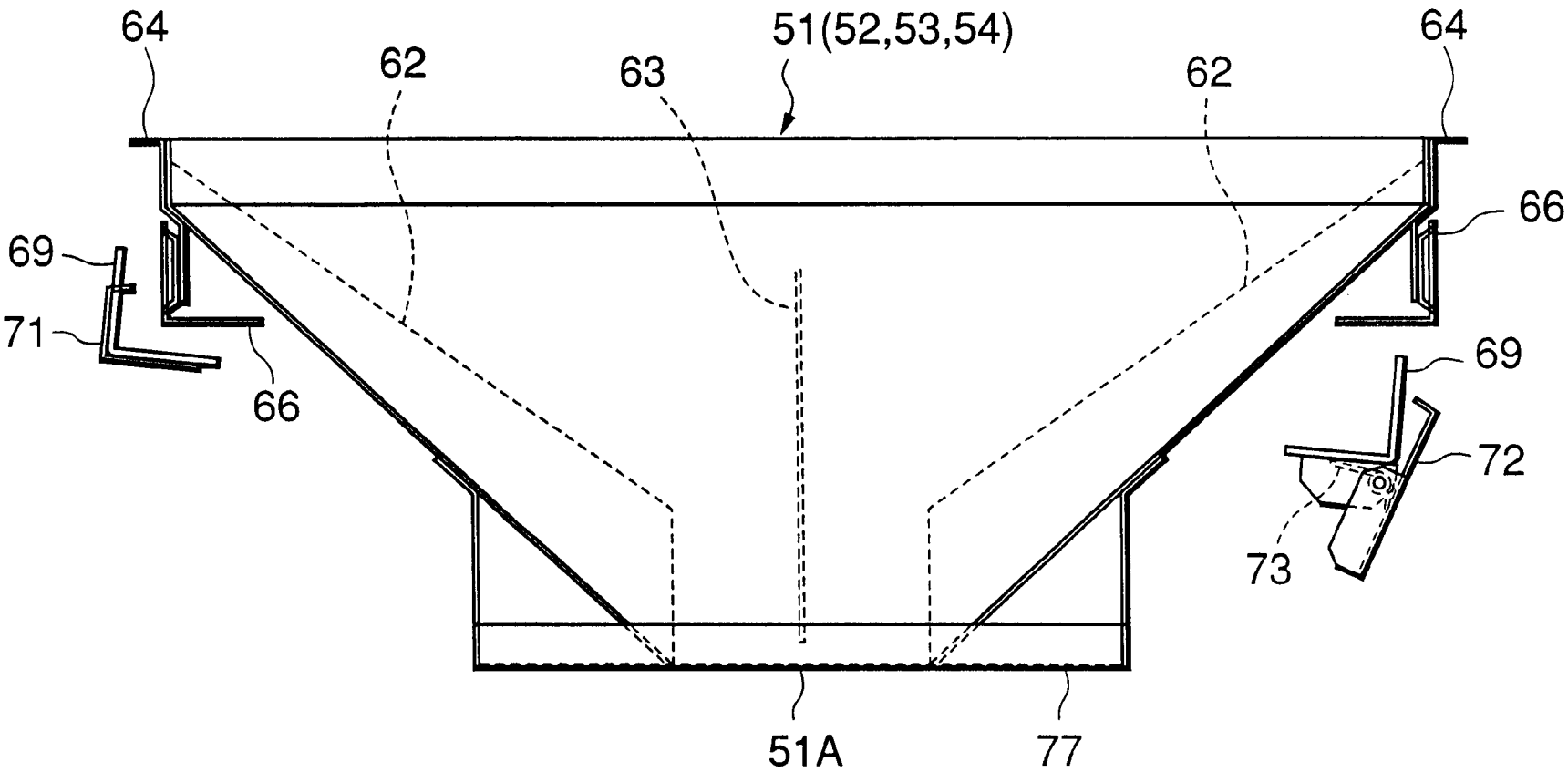
FIG. 12 is a front view of the hopper and the holding member for explaining a procedure for attaching the hopper of the solid preparation filling apparatus of the present invention.
Figure 13:
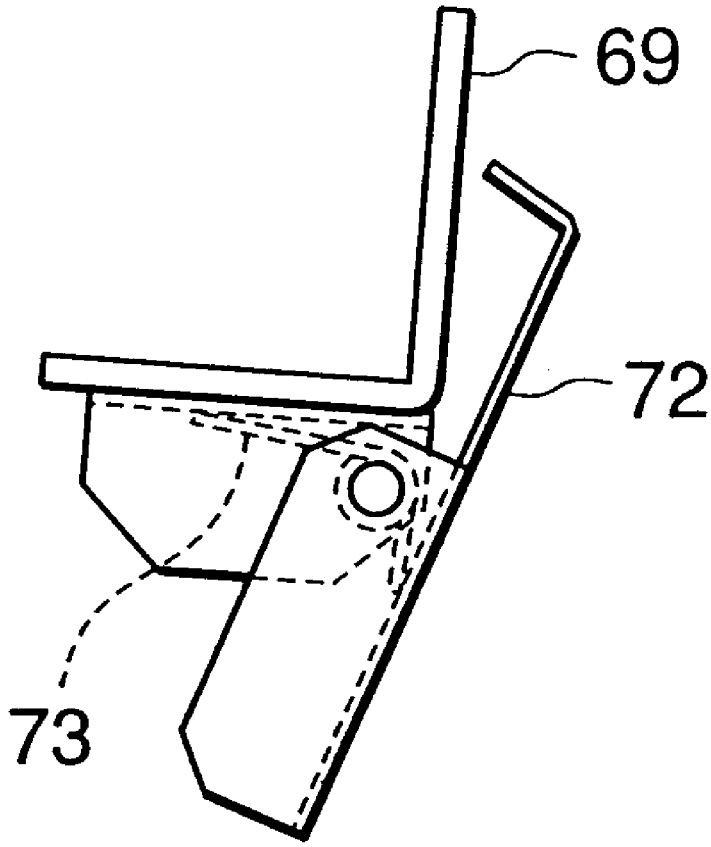
FIG. 13 is an enlarged view of the movable hook for explaining the operation of the movable hook of the solid preparation filling apparatus according to the present invention.

On the other hand, holding members (angles) 69 having a substantially-L-shaped cross section are fixed to the lower door 5 on the upper portion of the rail 59 of the lower door 5, and the respective hoppers 51 to 54 are attached to this holding members 69. In this case, inwardly protruding hook 71 is fixed to one side of the holding member 69, and a movable hook 72 which similarly protrudes inwards is attached to the holding portion 69 at a position opposed to the hook 71 in such a manner that the movable hook 72 can swivel without restraint. It is to be noted that a spring 73 always gives an impetus to the movable hook 72 so as to rotate in a direction it protrudes toward the inside of the holding member 69 (FIGS. 11 to 13). In addition, a micro switch 76 as hopper detecting means is disposed to the holding member 69 at a position corresponding to the fixing position of each of the hoppers 51 to 54.

Figure 9:
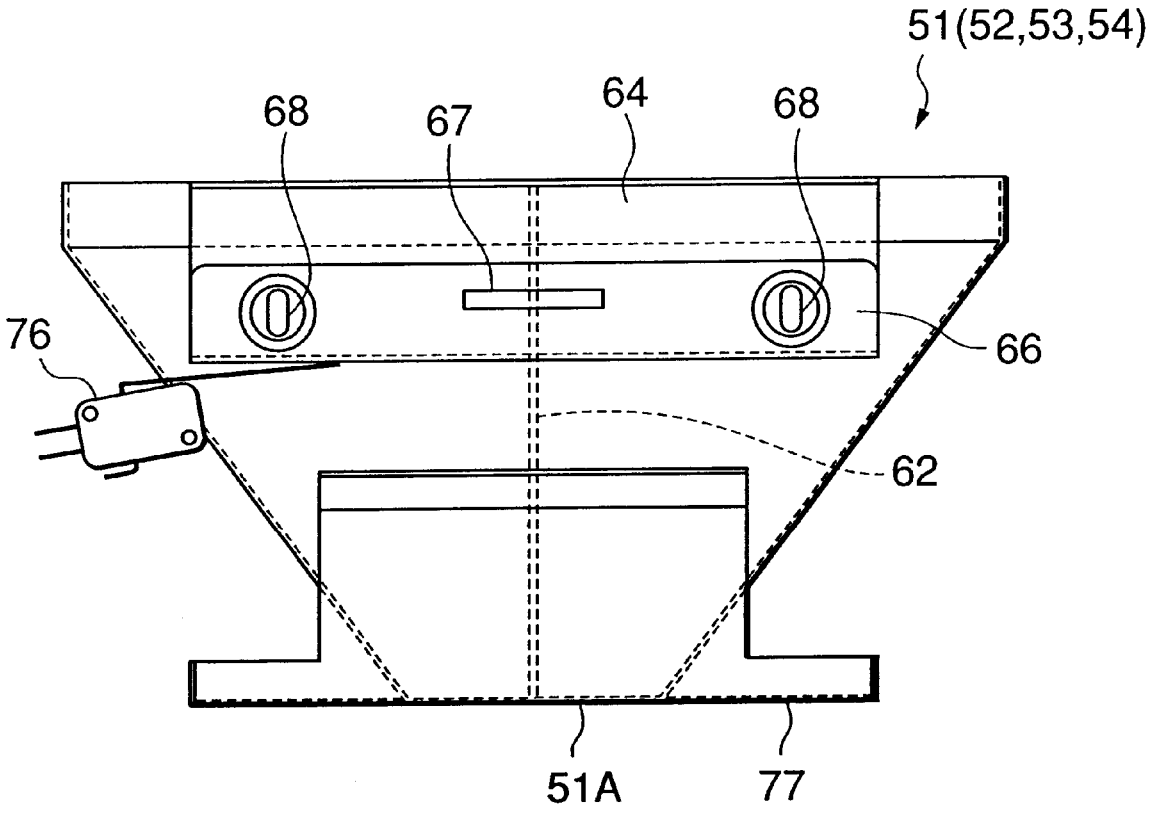
FIG. 9 is a side view showing the hopper of the solid preparation filling apparatus according to the present invention.
Figure 10:
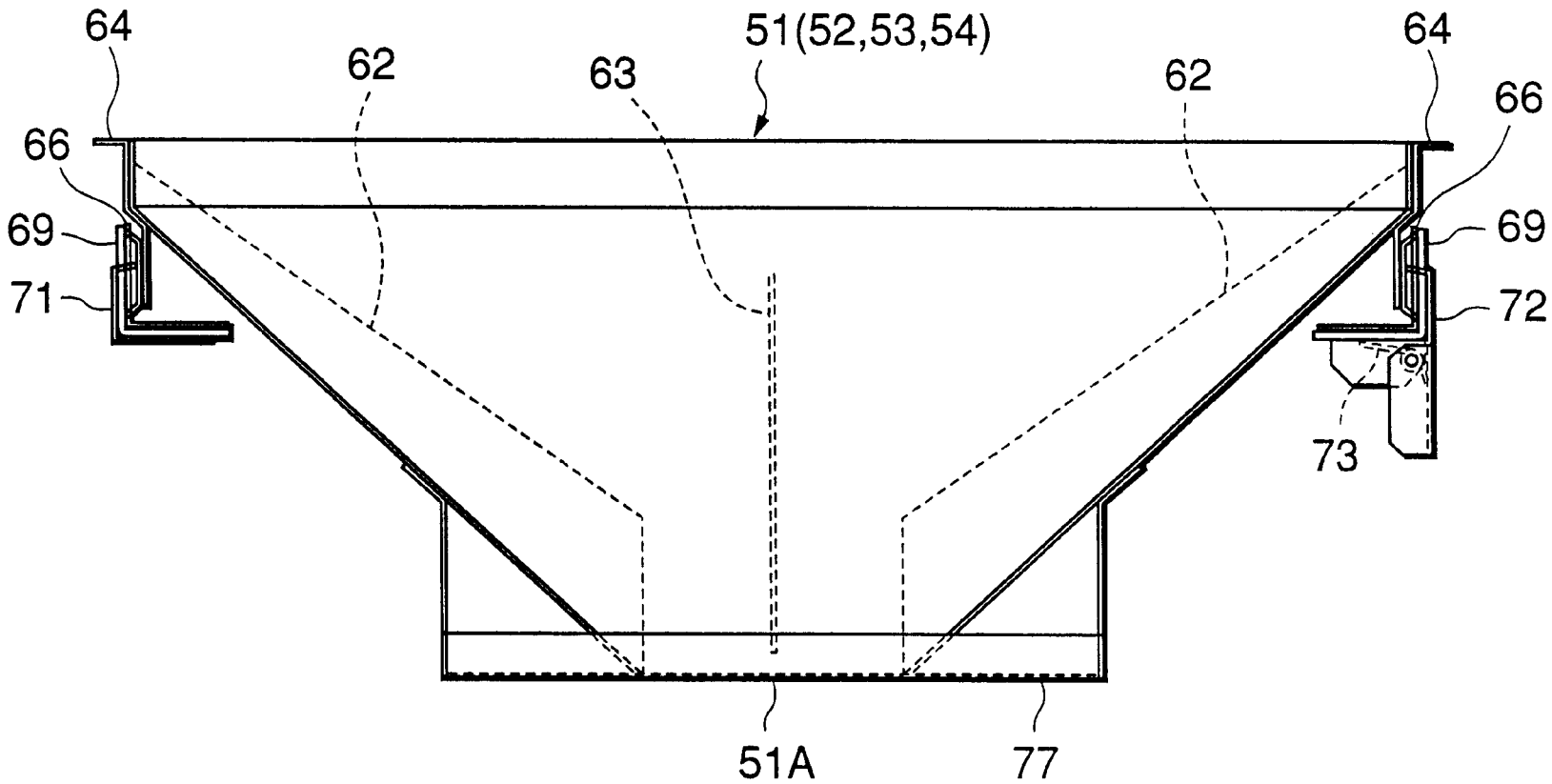
FIG. 10 is a front view of the hopper and a holding member of the solid preparation filling apparatus according to the present invention.

When attaching the hoppers 51 to 54 to the holding plate 69, one holding member 66 is first mounted on the holding member 69 and, at this time, the hook 71 is inserted into and engaged with the engagement hole 67 of the holding plate 66. Further, the lower portion of the movable hook 72 is pushed inwards against the impetus of the spring 73 to cause the movable hook 72 to swivel outside the holding member 69 in the clockwise direction in FIG. 12 (FIGS. 12 and 13). In this state, when the other holding plate 66 is mounted on the holding member 69 and the movable hook 72 is released, the movable hook 72 is caused to swivel in the counter-clockwise direction in FIG. 12 by the spring 73 and enter the engagement hole 67 of the other holding plate 66 for establishing engagement. This can fix the hoppers 51 to 54 on the holding member 69 and the holding plate 66 pushes the micro switch 76 as shown in FIG. 9.

Further, in case of removing the hoppers 51 to 54, when the movable hook 72 is first swiveled to be pulled out from the engagement hole 67 as opposite from the above and the hoppers 51 to 54 are diagonally pulled up, the engagement hole 67 of the other holding plate 66 can be released from the hook 71. Furthermore, removing the hoppers 51 to 54 can cause the micro switch 76 to enter the non-pressed state. Since the hoppers 51 to 54 are detachably attached on the holding members 69 in this manner, the maintenance work such as assembling or cleaning can be facilitated.

Figure 14:
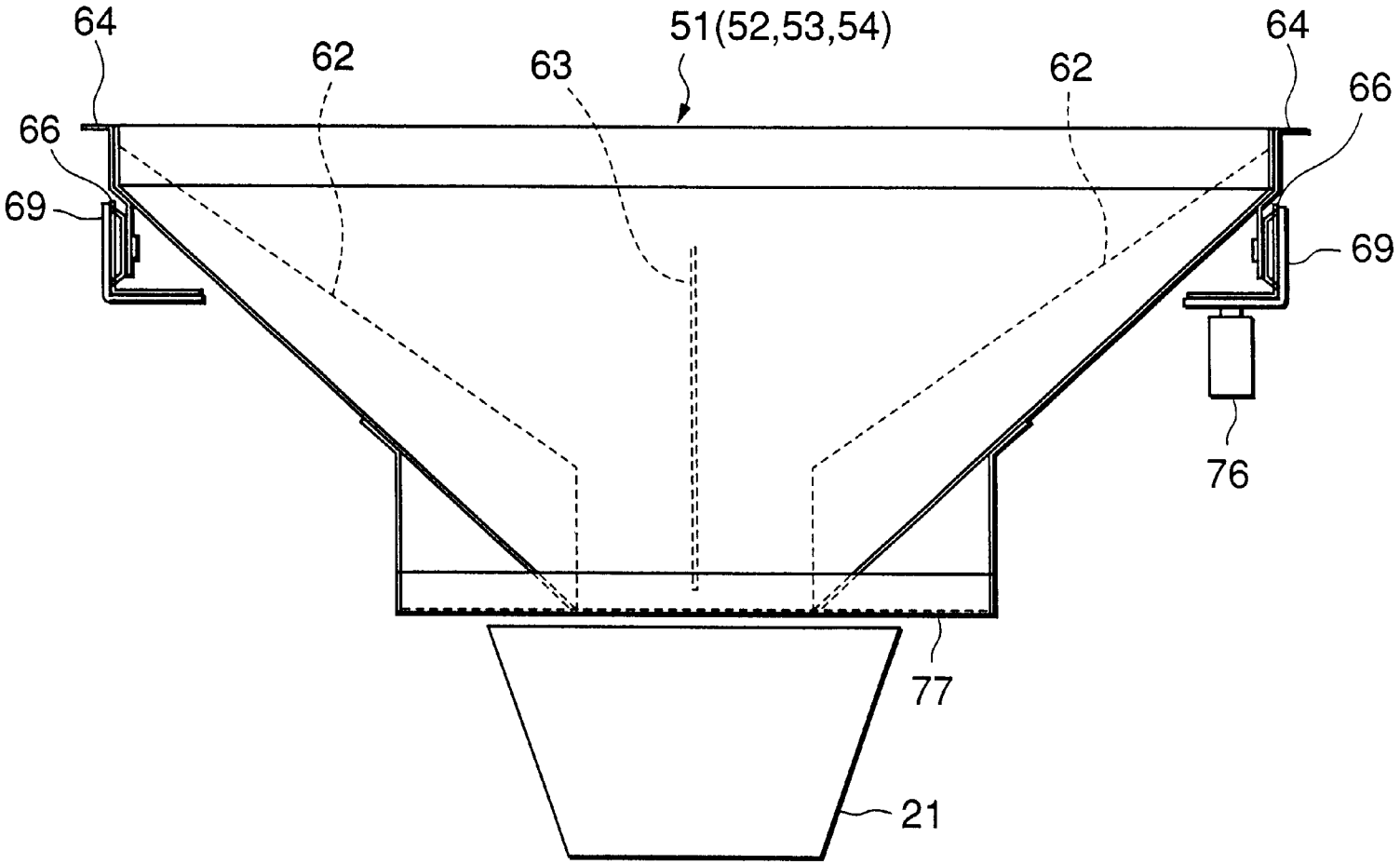
FIG. 14 is a front view of the hopper and a holding cell of the solid preparation filling apparatus according to the present invention.

In addition, since the height of the lower end of the holding plate 66 is adjustable as described above, the height of the discharge ports 51A to 54A of the hoppers 51 to 54 attached on the holding member 69 can be also adjusted in a vertical dimension range of the oval hole 68 by regulating the screwing height position of the holding plate 66. This can therefore facilitate adjustment of a clearance between a later-described holding cell 21 of a holding unit 61 positioned on the lower side and the discharge ports 51A to 54A (FIG. 14).

Moreover, a drop prevention wall 77 is disposed to the lower outer side of each of the hoppers 51 to 54 over the circumference of each of the discharge ports 51A to 54A so as to project outwards. Therefore, even if the solid preparation which has been ejected from each of the discharge ports 51A to 54A of the respective hoppers 51 to 54 and entered the holding cell is bounced to jump out from the clearance (FIG. 14) between the respective discharge ports 51A to 54A and the holding cell 21, the drop prevention wall 77 can bounce the solid preparation toward the holding cell 21.

Figure 16:
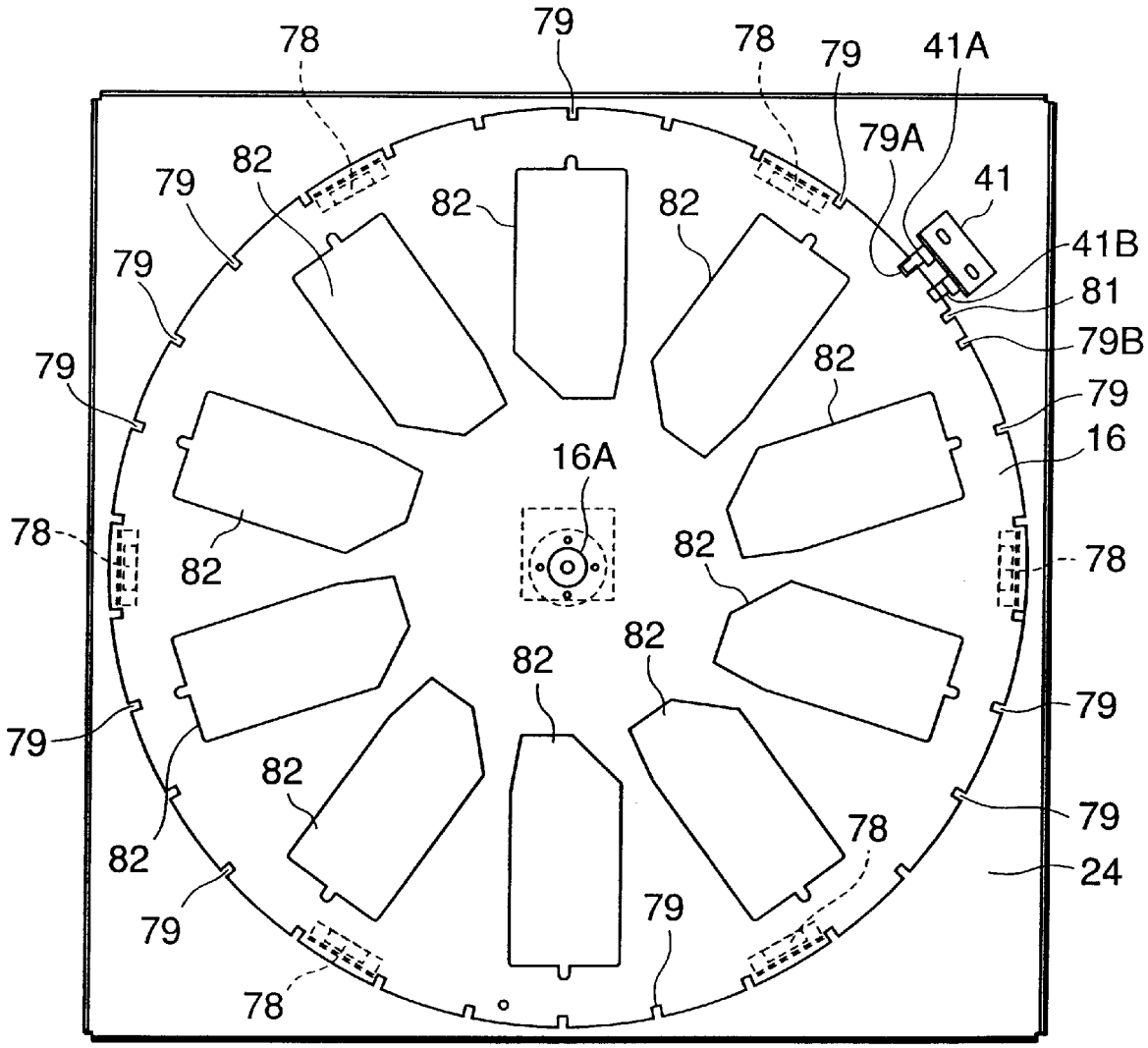
FIG. 16 is a plan view of the rotating plate and a base plate of the solid preparation filling apparatus according to the present invention.
Figure 17:
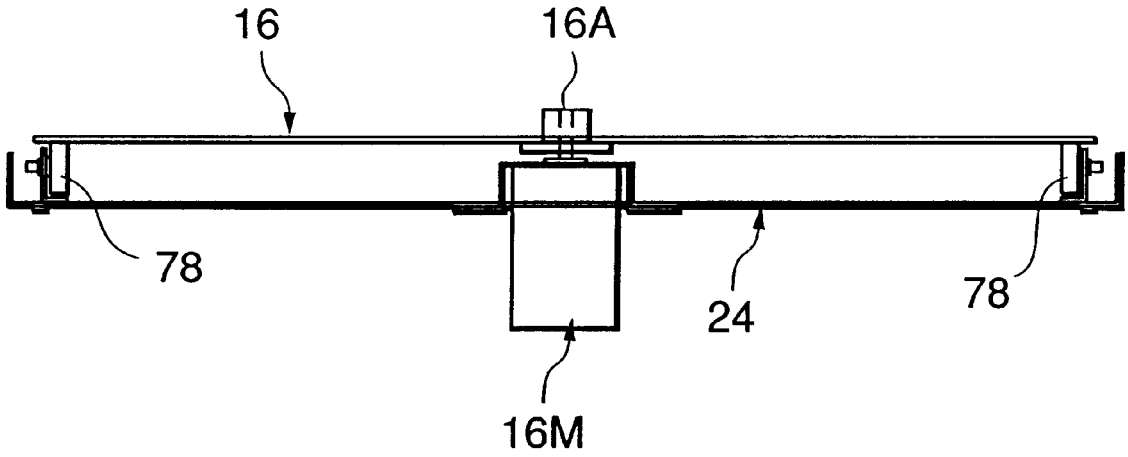
FIG. 17 is a longitudinal front view of the rotating plate and the base plate of the solid preparation filling apparatus according to the present invention.

On the other hand, although the rotating plate 16 is rotatably attached on the base plate 24 fixed to the lower door 5 as shown in FIGS. 16 an 17, the periphery of the rotating plate 16 is supported by six rollers 78. This extremely stabilizes rotation of the rotating plate 16. A rotating plate motor 16M (driving means) consisting of a pulse motor provided under the base plate 24 is connected to the rotational center 16A of the rotating plate 16, and the rotating plate 16 is driven to rotate by the rotating plate motor 16M. Additionally, notches 79 are formed on the peripheral portion of the rotating plate 16 at 12° intervals from the center. Further, a notch 81 is additionally formed at a position distanced from a given notch 79 (denoted by 79A in FIG. 16) at an interval of 8°.

Moreover, a transmission type rotational position detection sensor 41 for performing detection based on whether an irradiated light ray permeate to reach the top of the sensor is provided on the lower side of the periphery of the rotating plate 16, and a gap between and detection terminals 41A and 41B of the rotational position detection sensor 41 is determined as 4° in terms of a rotation angle of the rotating plate 16. Therefore, when the notch 81 and its nearest notch 79 (indicated by 79B in FIG. 16) move to the positions directly above these terminals, light paths for detection are formed to the both detection terminals 41A and 41B.

Figure 18:
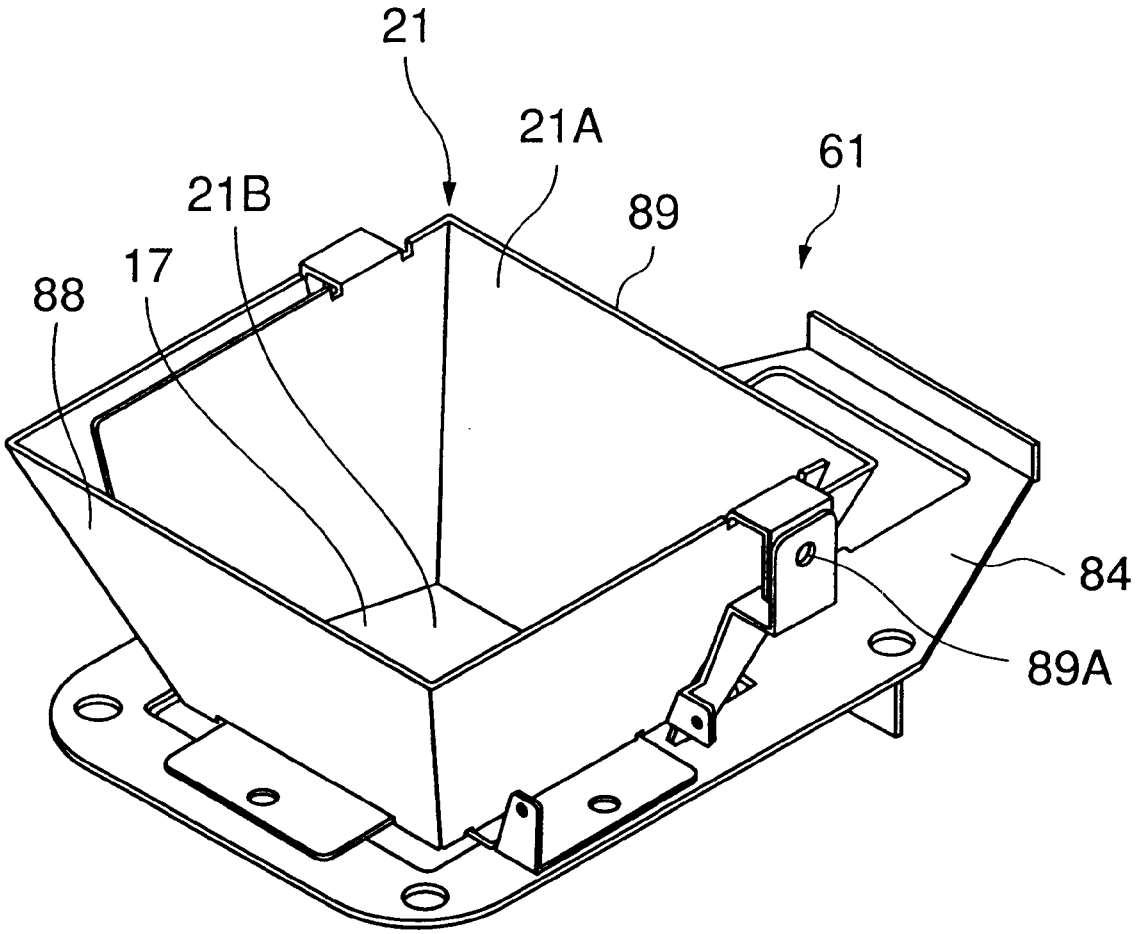
FIG. 18 is a perspective view of the holding unit of the solid preparation filling apparatus according to the present invention.
Figure 19:
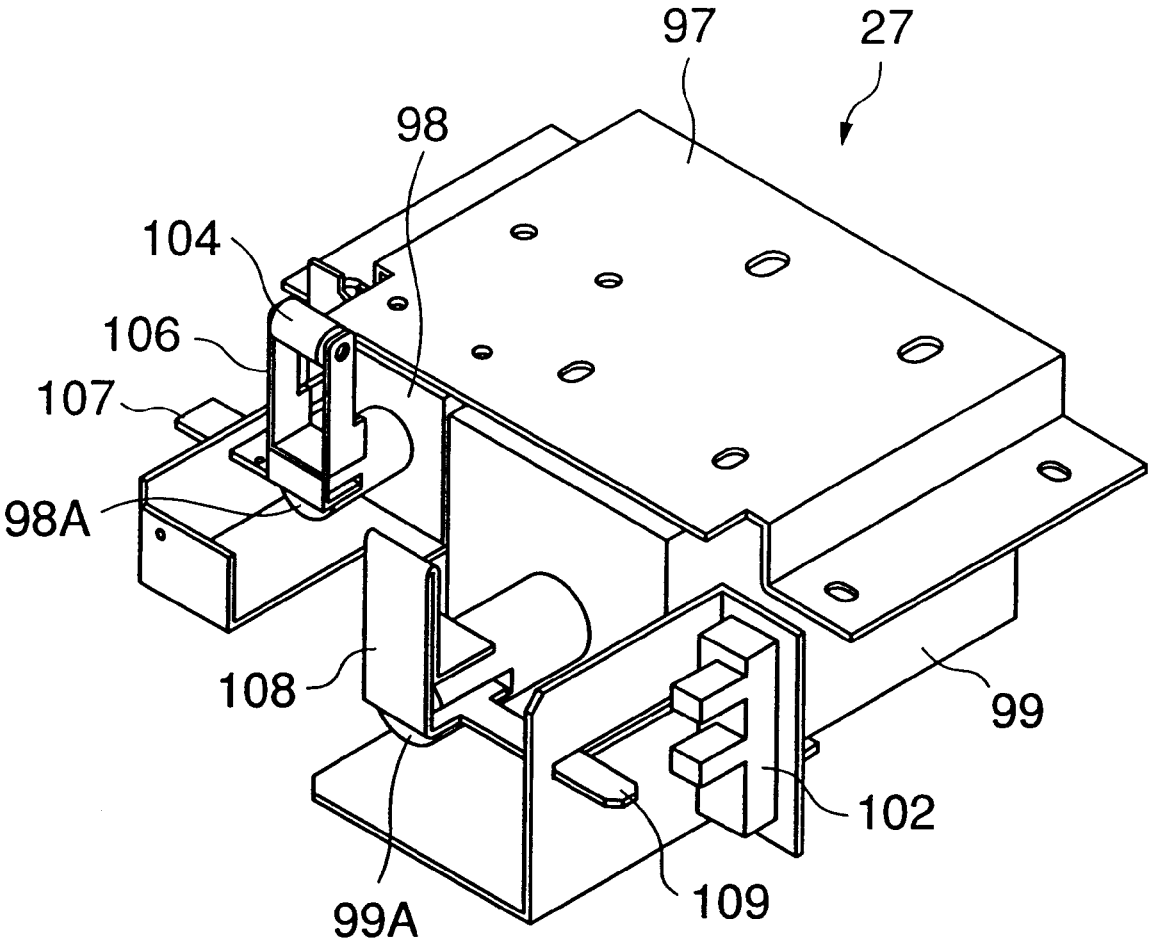
FIG. 19 is a perspective view of the solenoid unit of the solid preparation filling apparatus according to the present invention.

A total of ten openings 82 (they are formed at 36° intervals as an angle from the rotational center 16A of the rotating plate 16) are formed at the periphery of the rotating plate 16 in this embodiment, and each holding unit 61 shown in FIG. 18 is fixed on the rotating plate 16 by a snap type fixture 100 so as to block each opening 82. Further, a solenoid unit 27 (shown in FIG. 19) constituting the driving means is attached to the front center of the base plate 24 under the rotating plate 16.

Figure 15:
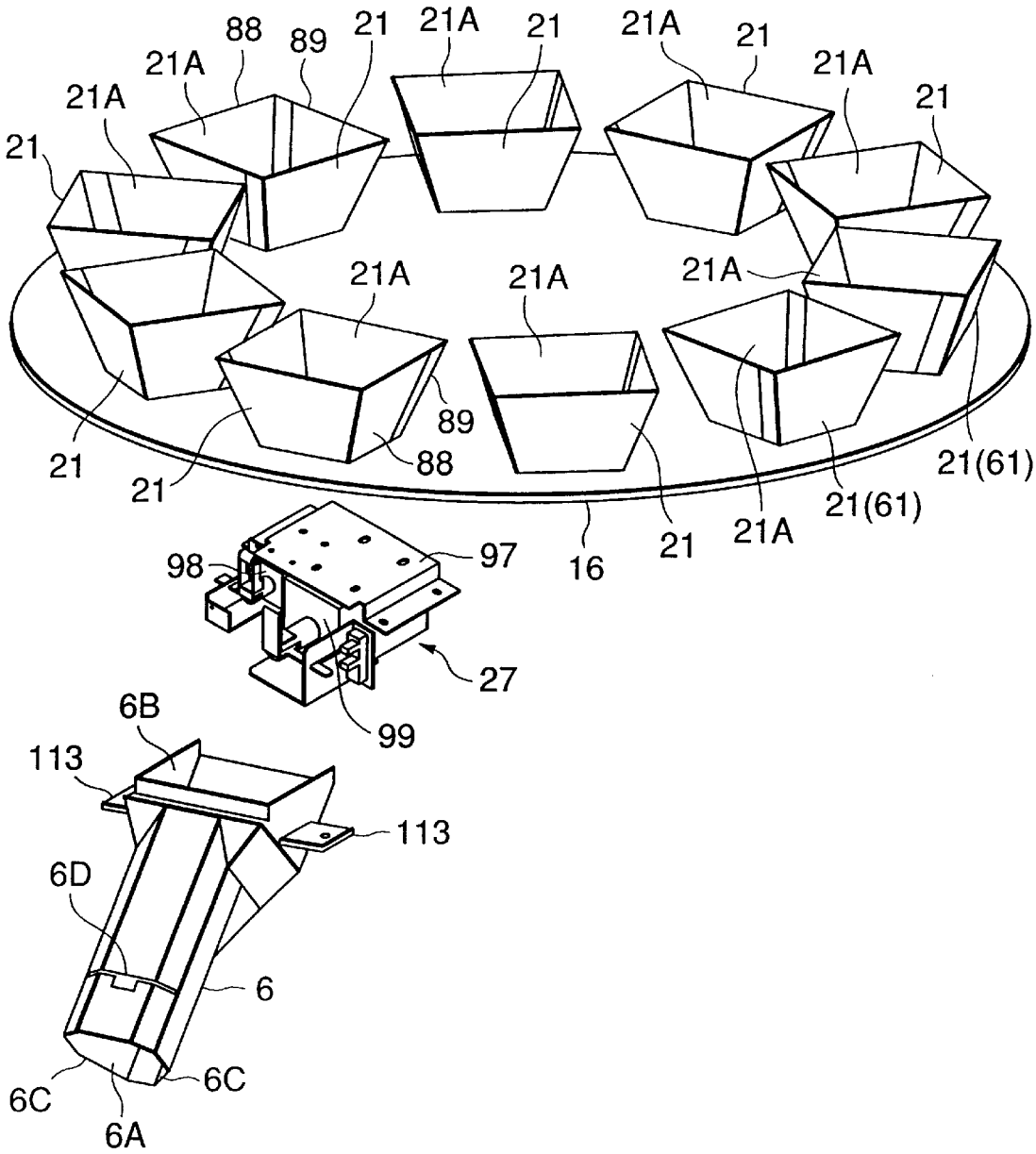
FIG. 15 is a perspective view showing the arrangement of a holding unit, a rotating plate, a solenoid unit and a shoot of the solid preparation filling apparatus according to the present invention.
Figure 32:
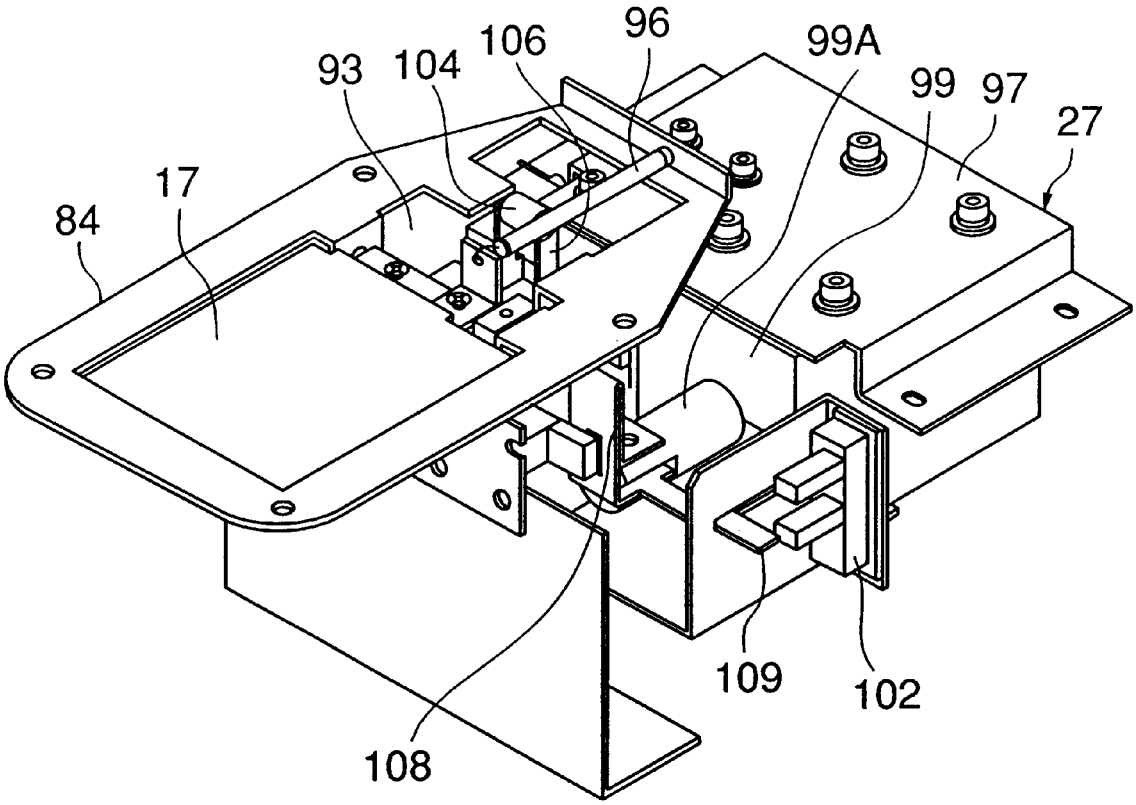
FIG. 32 is a perspective view showing the holding unit and the solenoid unit except the holding cell of the solid preparation filling apparatus according to the present invention, with the shutter being closed.
Figure 33:
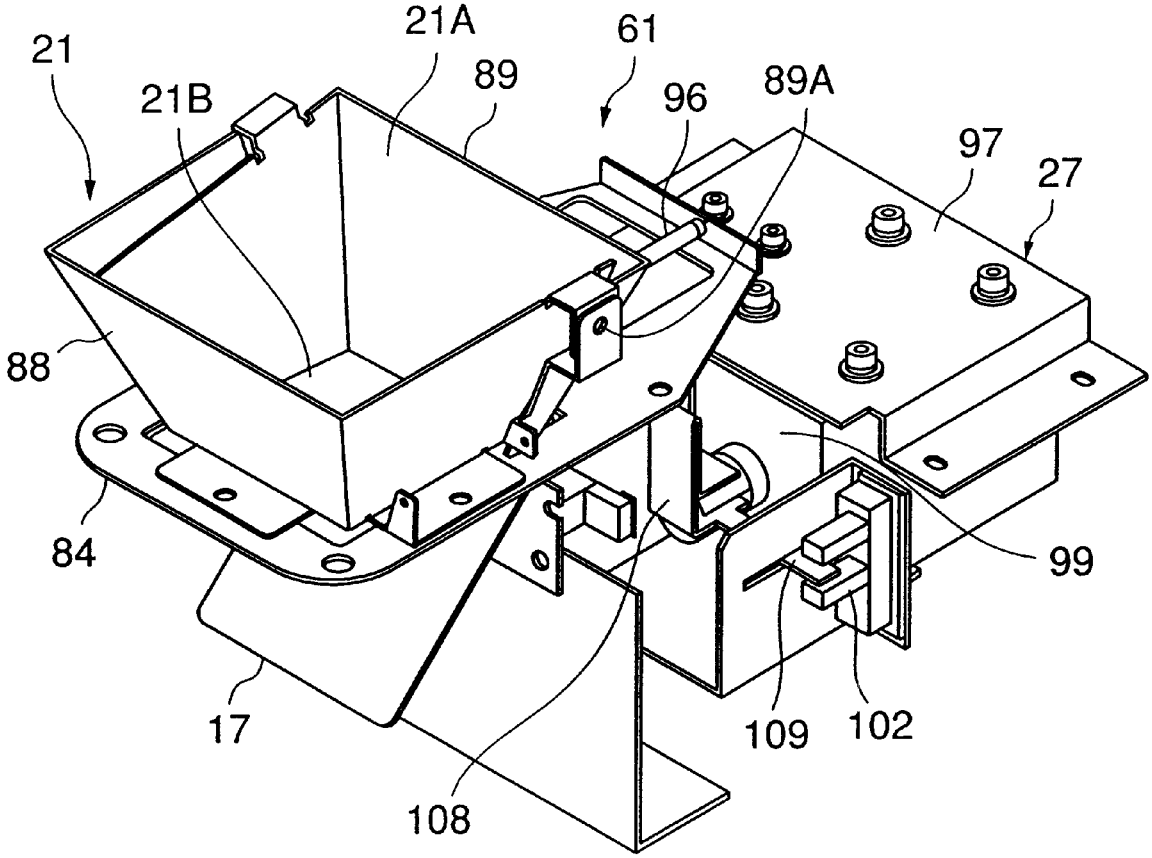
FIG. 33 is a perspective view showing the holding unit and the solenoid unit of the solid preparation filling apparatus according to the present invention, with the shutter being opened.

The holding unit 61 is made up of a frame-like holding cell 21 mounted on a substrate 84 such as shown in FIG. 32, a shutter 17 disposed on the bottom side of the holding cell 21 and others. Each holding cell 21 is provided with an inlet 21A on the upper end and an outlet 21B on the lower end and has a shape like a container in which the side of the inlet 21A is widened as a whole, and it is arranged on one circumference around the rotational center 16A of the rotating plate 16 when each holding unit 61 is attached on the rotating plate 16 (FIG. 15).

Here, the discharge ports 51A to 54A of the hoppers 51 to 54 are arranged on one circumference, and this circumference is matched with the upper side of the circumference on which the holding cells 21 are provided. In addition, the inlet 21A of each holding cell 21 is positioned directly below each discharge port 51A, 52A, 53A or 54A (the clearance between the both members is adjustable as described above). That is, the inlets 21A of the holding cells 21 are driven to rotate on the circumference on which the discharge ports 51A of the hoppers 51 to 54 exist by rotation of the rotating plate 16.

Figure 20:
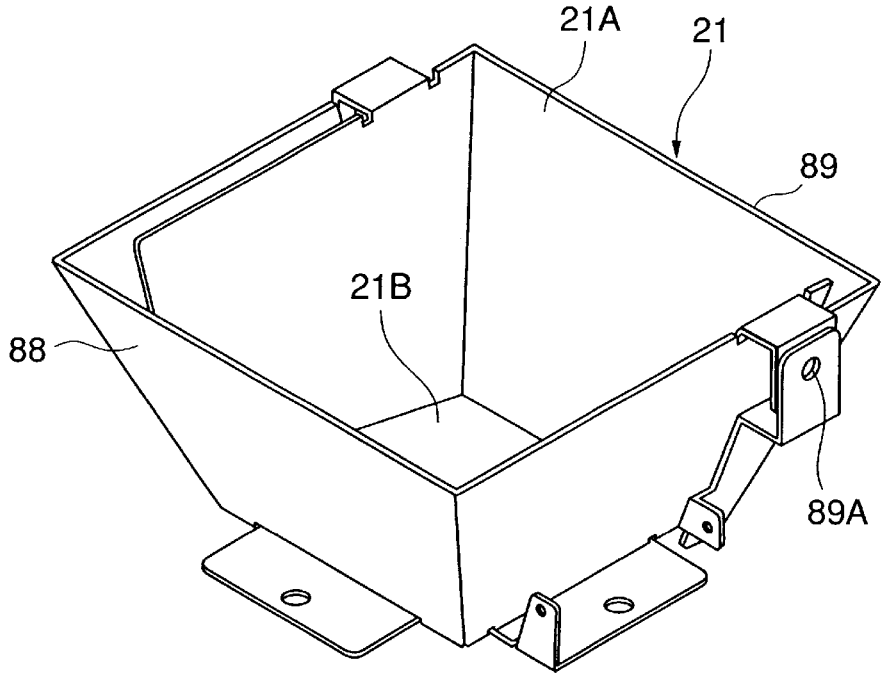
FIG. 20 is a perspective view showing the holding cell of the solid preparation filling apparatus according to the present invention.
Figure 21:
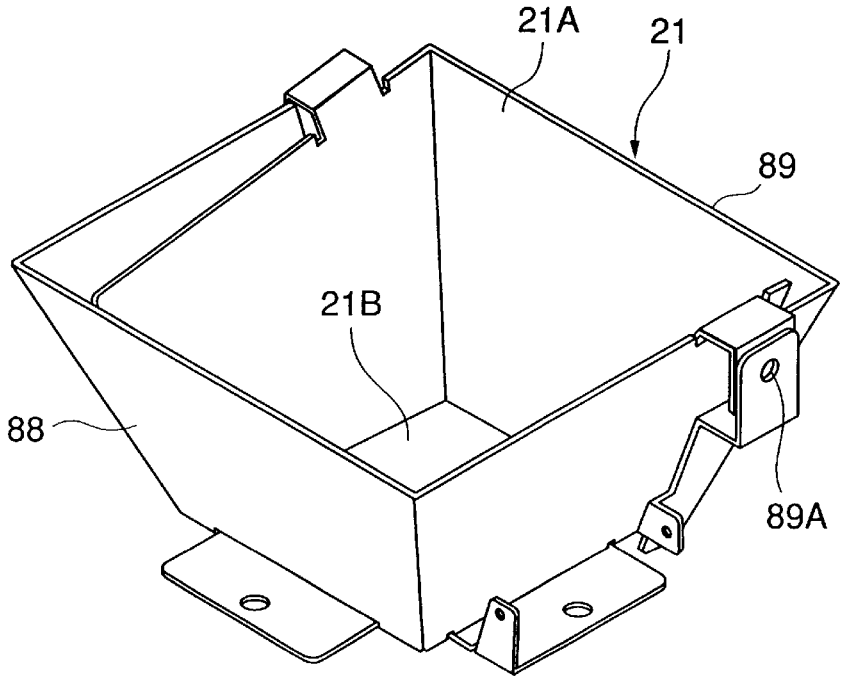
FIG. 21 is a perspective view showing the holding cell of the solid preparation filling apparatus according to the present invention, wherein the movable cell is moved.
Figure 22:
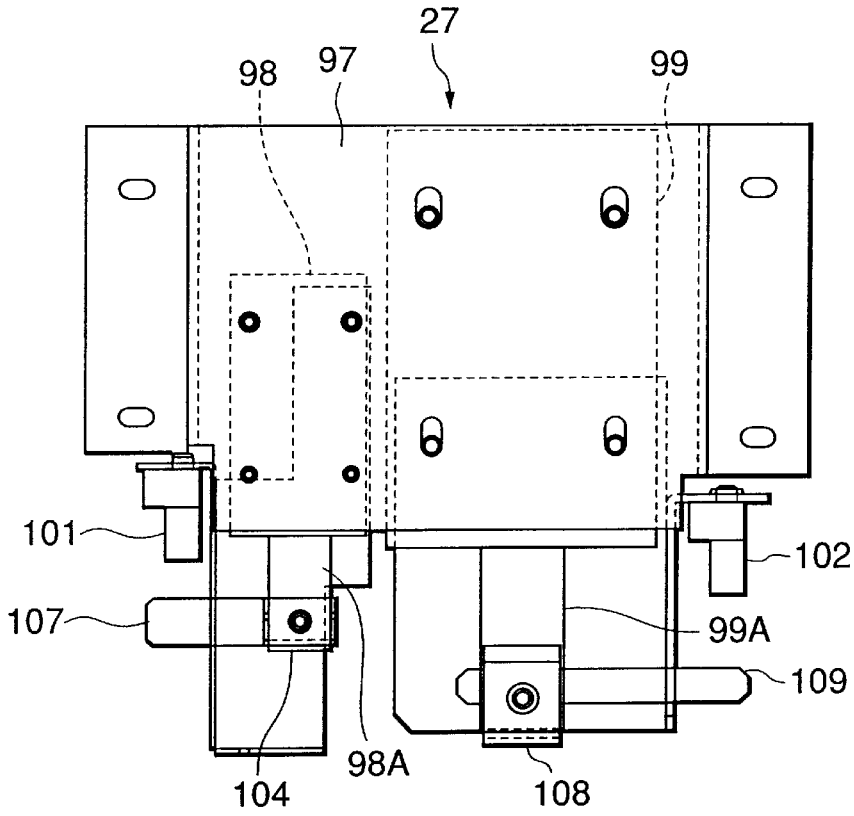
FIG. 22 is a plan view showing the solenoid unit of the solid preparation filling apparatus according to the present invention.
Figure 23:
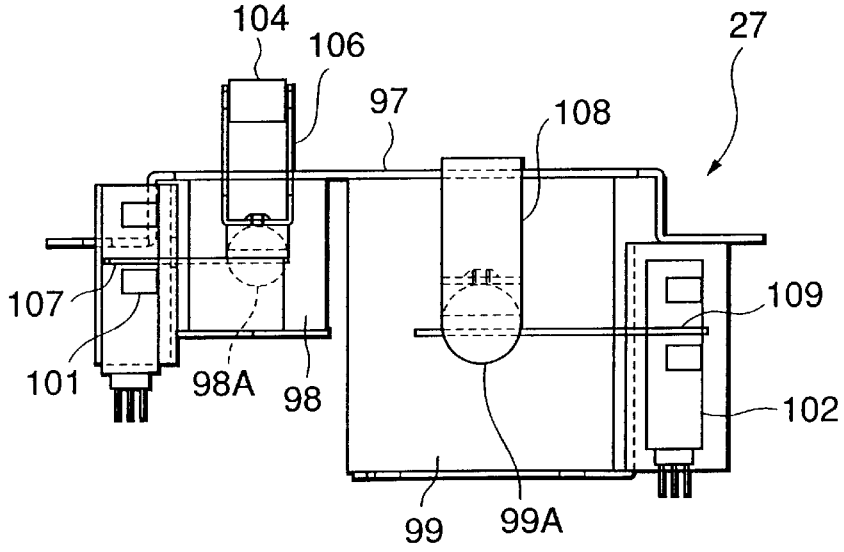
FIG. 23 is a front view of the solenoid unit of the solid preparation filling apparatus according to the present invention.
Figure 24:
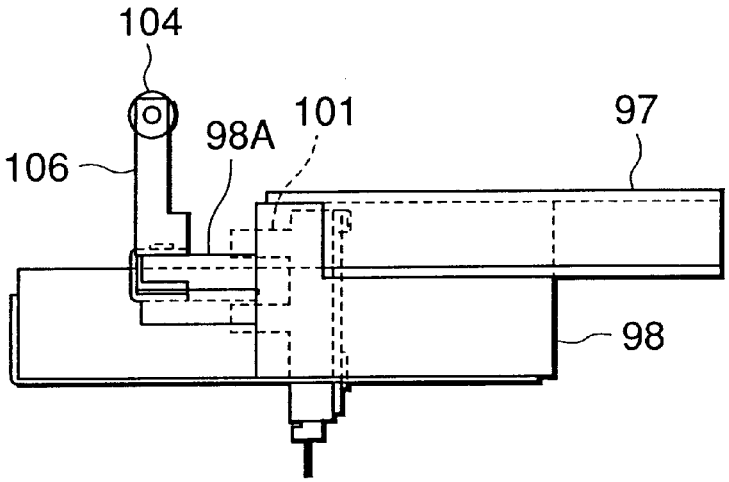
FIG. 24 is a longitudinal side view showing a solenoid portion for a cell of the solenoid unit of the solid preparation filling apparatus according to the present invention.
Figure 25:
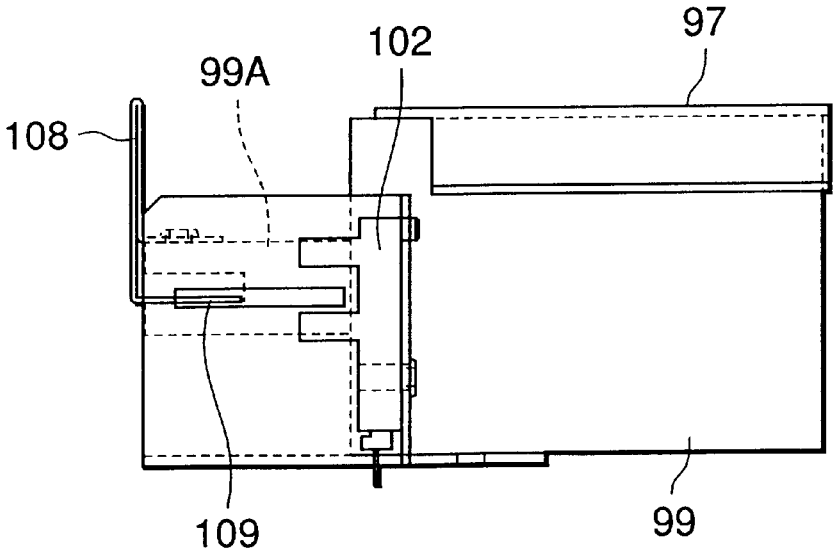
FIG. 25 is a longitudinal side view of a solenoid portion for a shutter of the solenoid unit of the solid preparation filling apparatus according to the present invention.

In this case, the holding cell 21 is constituted by a substantially-U-shaped fixed cell 88 fixed to the substrate 84 and a substantially-L-or U-shaped movable cell 89 attached to the fixed cell 88 so as to be capable of swiveling without restrain (FIG. 20). The movable cell 89 is combined with the fixed cell 88 to form a container-like shape as described above. When the movable cell 89 is swiveled (moved) outwards because the outer upper end thereof is pivoted and supported on the fixed cell 88 so as to be capable of swiveling (the pivot portion is denoted by reference numeral 89A), the lower outlet 21B is enlarged as shown in FIG. 21.

Figure 31:
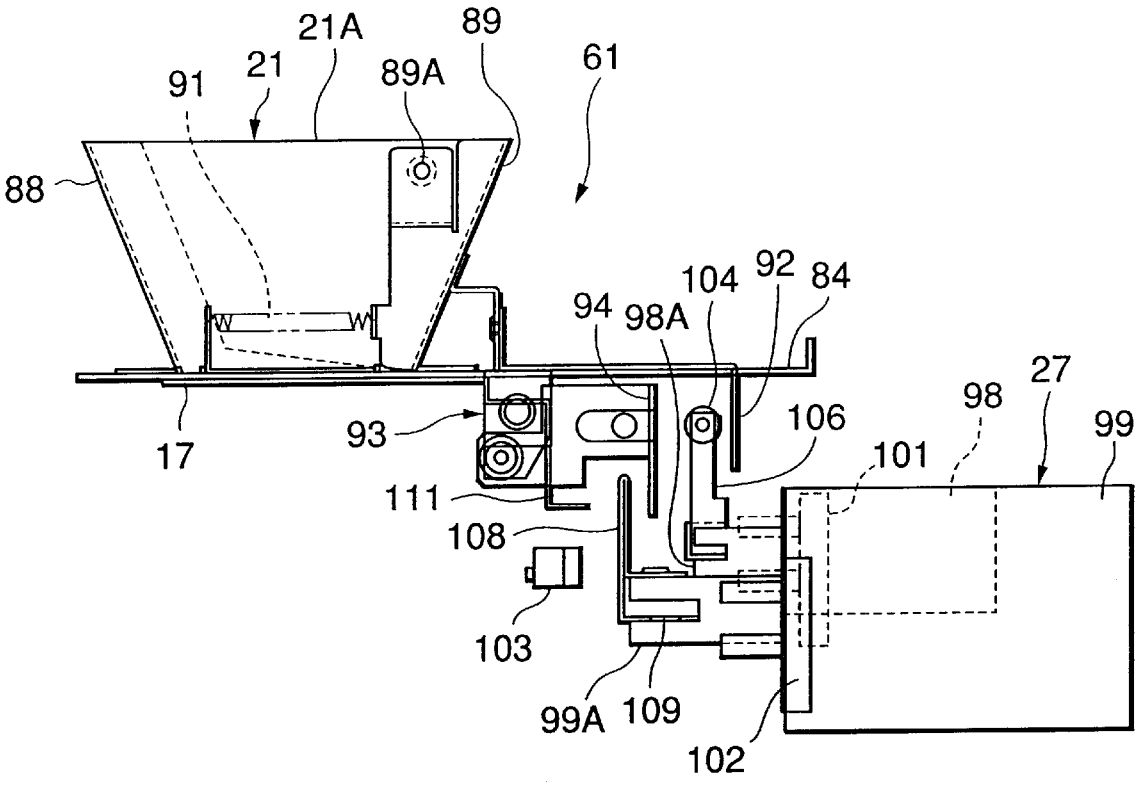
FIG. 31 is a side view showing the holding unit and the solenoid unit of the solid preparation filling apparatus according to the present invention, with the shutter being closed.

It is to be noted that a spring 91 shown in FIG. 31 constantly gives an impetus to the movable cell 89 in a direction for narrowing the outlet 21B. Further, an operating plate 92 which downwardly extends and projects from the substrate 84 (rotating plate 16) is attached to the outer face of the movable cell 89 as shown in FIG. 31.

Further, the shutter 17 is pivoted and supported by a link mechanism 93 on the bottom side of the substrate 84 and positioned in the opening 82. The link mechanism 93 converts the horizontal movement of the operating plate 94 toward the rear side (direction toward the rotational center 16A of the rotating plate 16) into rotating operation of the shutter 17. Additionally, a substantially-L-shaped sensing plate 111 which extends downwardly is attached to the shutter 17. An impetus is constantly given to the shutter 17 by the spring 96 shown in FIG. 32 so as to close the outlet 21B of the holding cell 21 (horizontal state), and the end of the shutter moves down to open the outlet 21B when the operating plate 94 moves rearwards against the spring 96 (FIG. 34).

Meanwhile, the solenoid unit 27 is made up of a frame 97, a solenoid 98 for a cell as driving means attached to the frame 97, a solenoid 99 for a shutter, a cell opening sensor (movable cell operation detecting means) 101 composed of a photo coupler, a shutter opening sensor (shutter opening/closing detecting means) 102, a reflection type shutter closing sensor (shutter opening/closing detecting means) 103, and others as shown in FIGS. 22 to 25. A driving plate 106 which is upwardly extended and provided with a roller 104 at the end thereof is attached to the end of a plunger 98A of the solenoid 98 for a cell, and a sensing plate 107 projecting to the side portion is provided to the plunger 98A. Also, a driving plate 108 which upwardly extends is attached to the end of a plunger 99A of the solenoid 99 for a shutter, and a sensing plate 109 projecting to the side portion is provided to the plunger 99A.

With the plungers 98A and 99A of the both solenoids 98 and 99 projecting, the driving plate 106 is detachably positioned on the front side (circumferential side of the rotating plate 16) of the operating plate 92 with a gap therebetween as shown in FIG. 31, and the driving plate 108 is also detachably positioned on the front side of the operating plate 94 with a gap therebetween. The solenoid unit 27 (driving plate 106 and 108 and others) does not interfere with movement of the operating plates 92 and 94 and the sensing plate 111 involved by rotation of the rotating plate 16.

Figure 34:
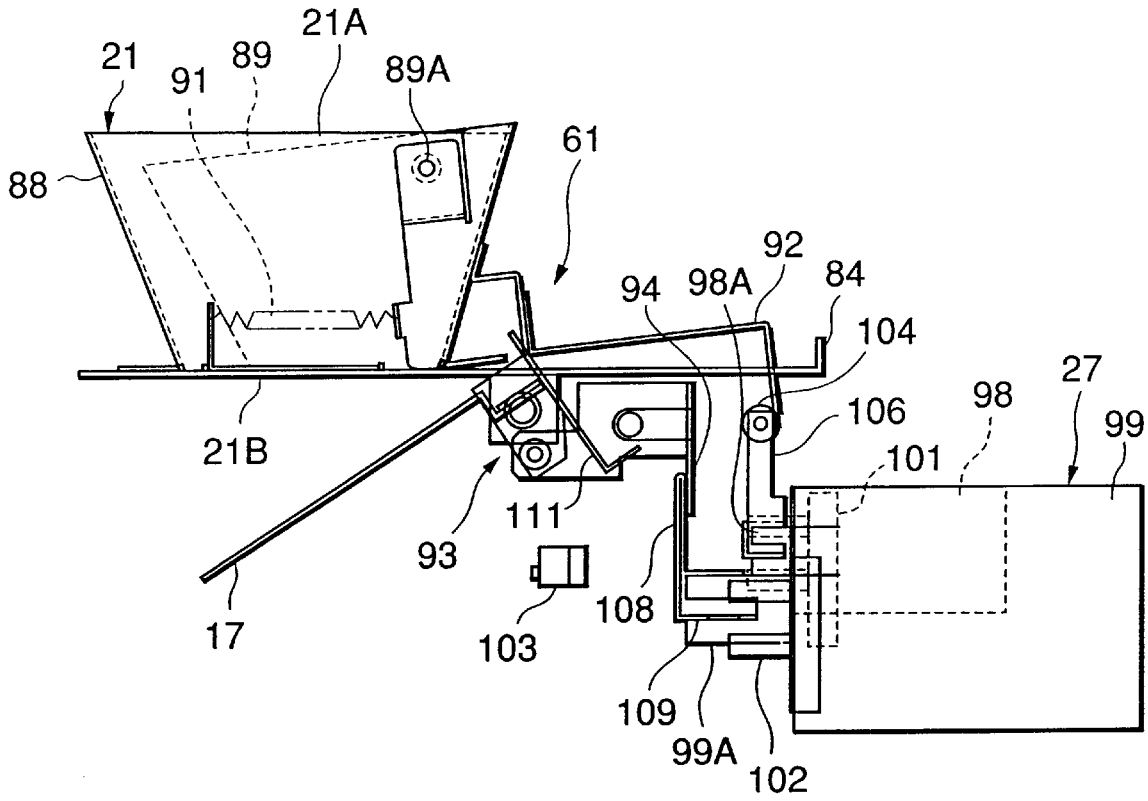
FIG. 34 is a side view showing the holding unit and the solenoid unit of the solid preparation filling apparatus according to the present invention, with the shutter being opened.
Figure 35:
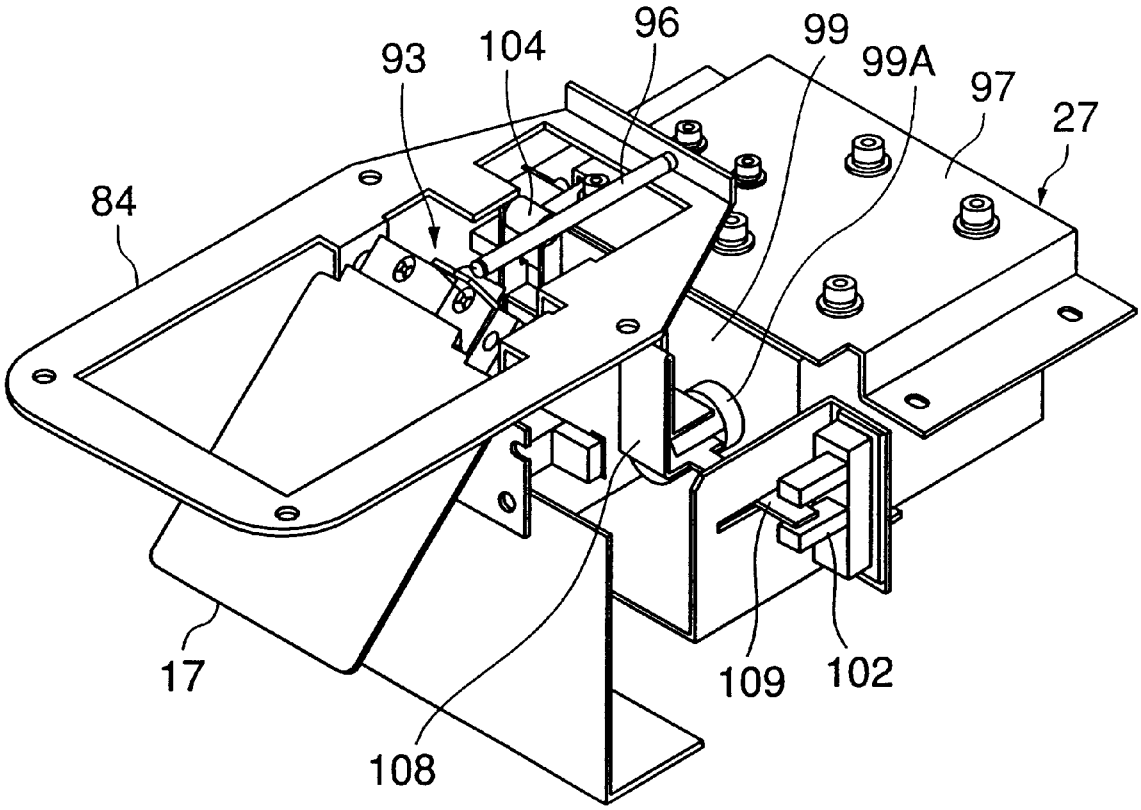
FIG. 35 is a perspective view showing the holding unit and the solenoid unit except the holding cell of the solid preparation filling apparatus according to the present invention, with the shutter being opened.

When the plunger 98A is energized by the solenoid 98 for a cell to be attracted, since the roller 104 of the driving plate 106 comes into contact with and attracts the operating plate 92 of the holding unit 61 moved to the front central portion of the base plate 24, the movable cell 89 is caused to swivel to open the outlet 21B of the holding cell 21 (FIG. 34). At the same time, the sensing plate 107 blocks the optical path of the cell opening sensor 101.

When the plunger 99A is energized by the solenoid for a shutter 99 to be attracted, since the driving plate 108 attracts the operating plate 94 of the holding unit 61 in contact therewith, the shutter 17 is caused to swivel to open the outlet 21B of the holding cell 21 (FIG. 34). Simultaneously, the sensing plate 109 blocks the optical path of the shutter opening sensor 102. Further, when the shutter 17 is closed (horizontal) as shown in FIG. 31, the sensing plate 111 reflects a light ray in opposition to the upper portion of the closing sensor 103, thereby detecting closure of the shutter 17.

Figure 26:
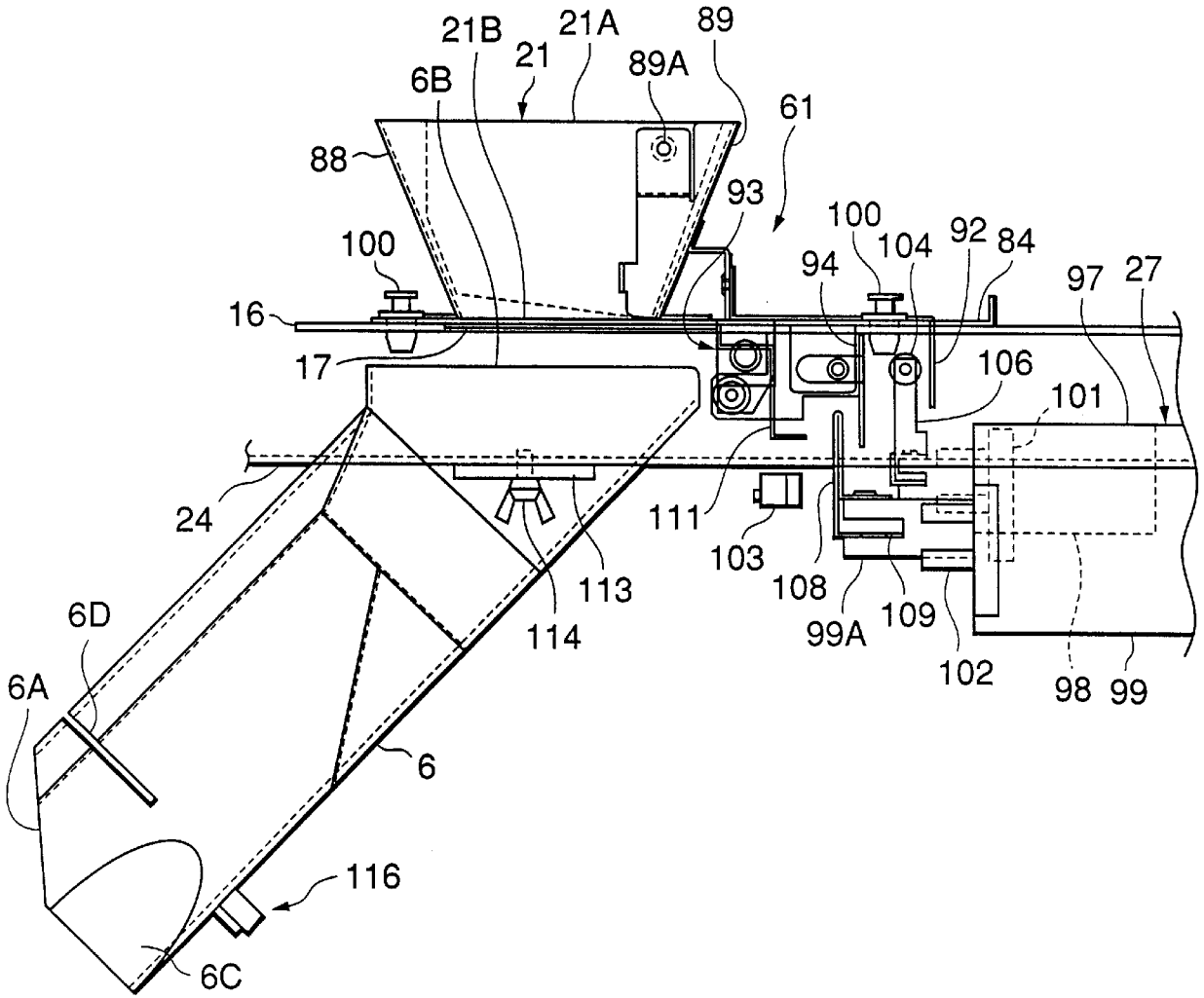
FIG. 26 is a side view showing the holding unit, the solenoid unit, the shoot and others of the solid preparation filling apparatus according to the present invention.
Figure 27:
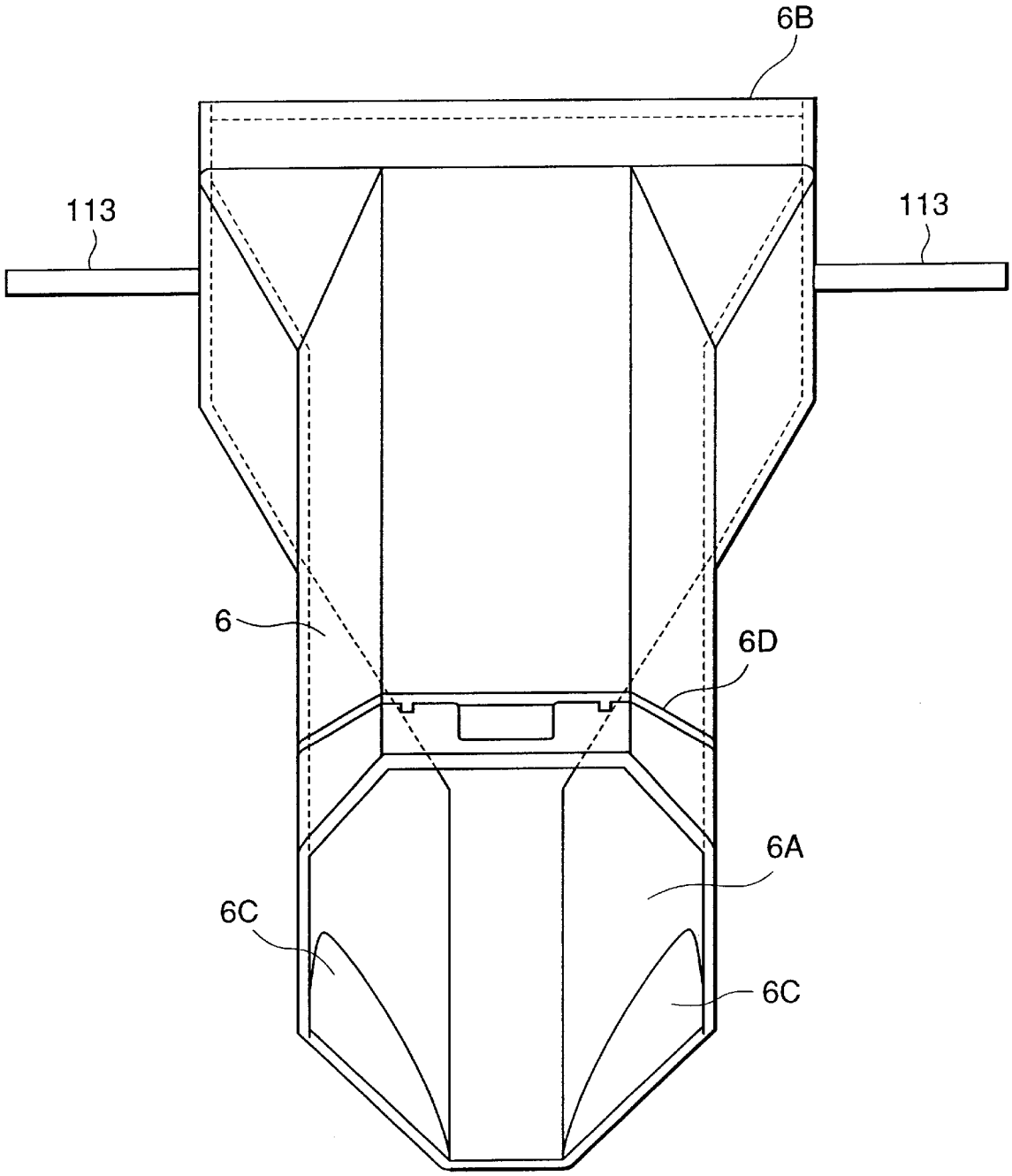
FIG. 27 is a plan view showing the shoot of the solid preparation filling apparatus according to the present invention.
Figure 28:
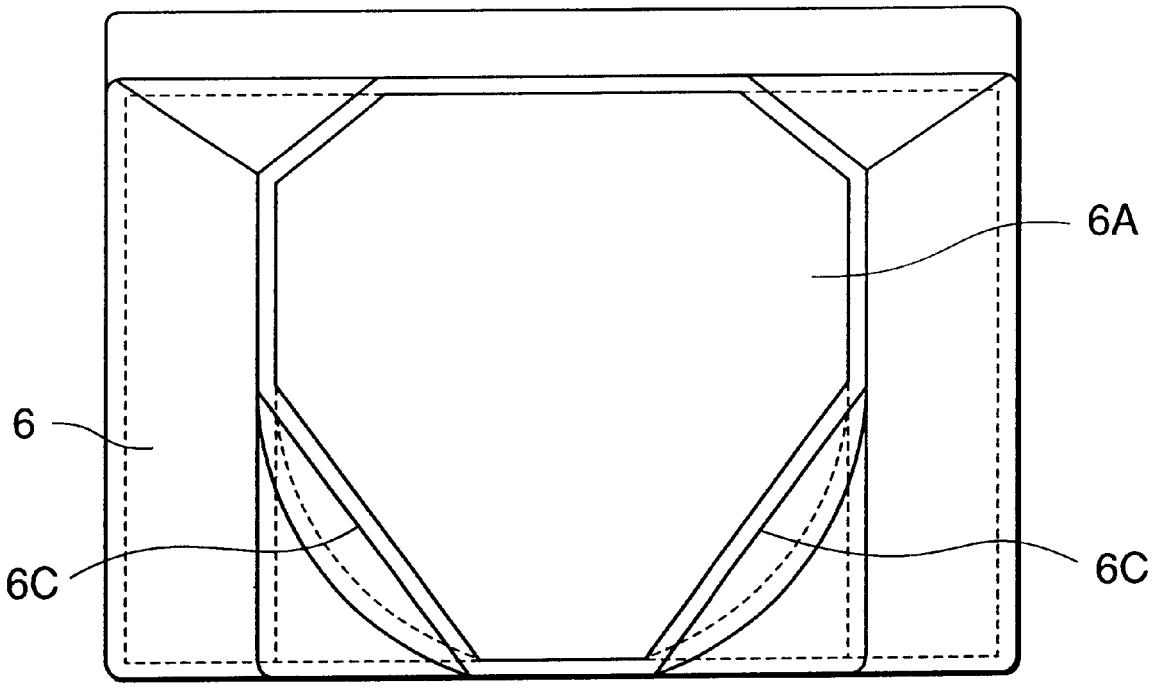
FIG. 28 is a bottom view showing the shoot of the solid preparation filling apparatus according to the present invention.
Figure 29:
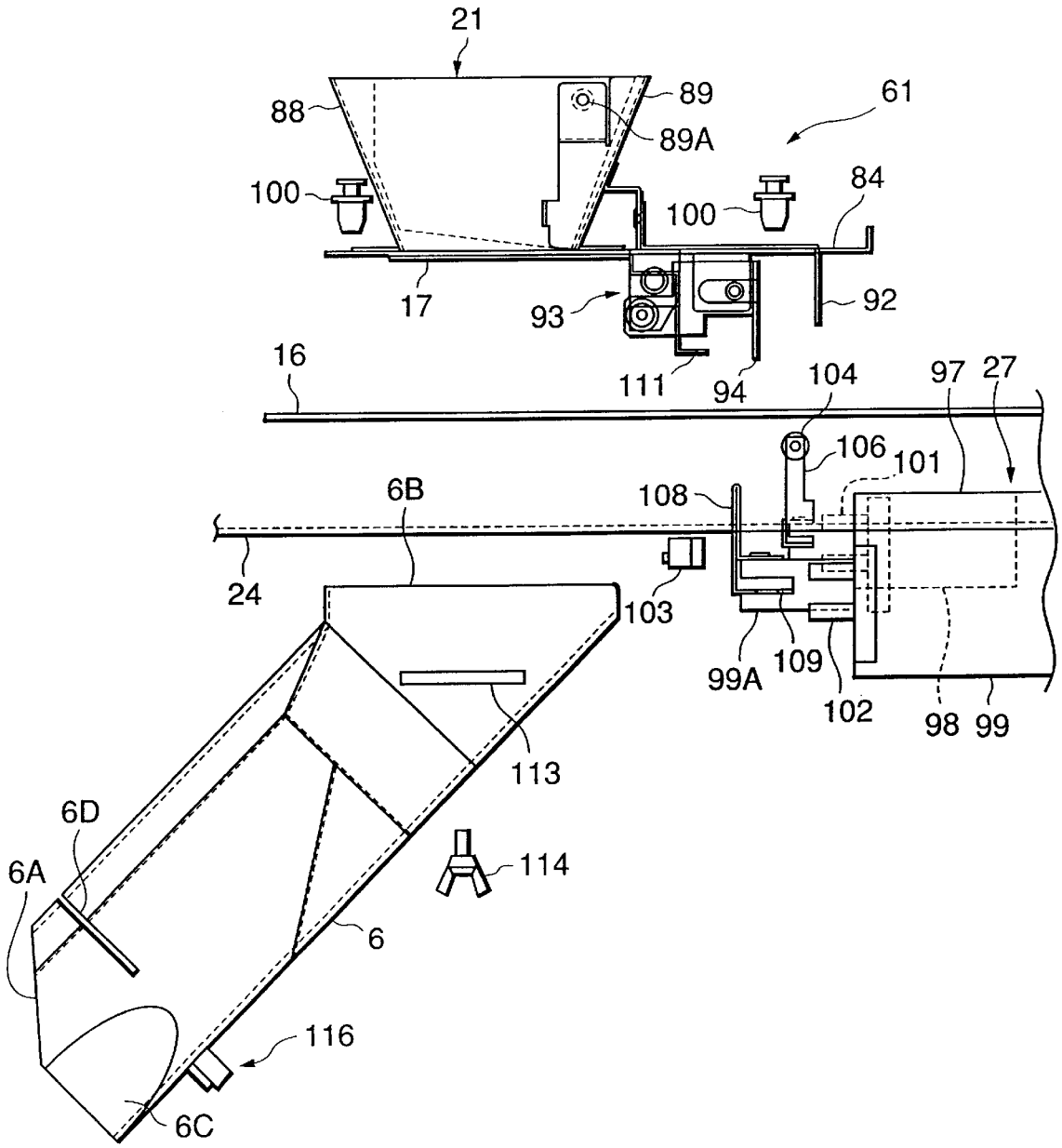
FIG. 29 is an exploded side view showing the holding unit, the solenoid unit, the shoot and others of the solid preparation filling apparatus according to the present invention.

On the other hand, the shoot 6 is molded from a transparent hard synthetic resin and has a cylindrical shape with a polygonal section as shown in FIGS. 27 and 28, and its each fixing flange 113 protruding in the horizontal direction from the upper portion thereof is detachably fixed to the front central portion of the base plate 24 by a thumbscrew 114 (FIG. 26). This causes the upper end inlet 6B of the shoot 6 to be opened upwards at the front central portion of the base plate 24, and the solenoid unit 27 is positioned at the rear of the shoot 6. Since the shoot 6 is attached to the base plate 24 by using the thumbscrew 114 in this manner, only the shoot 6 can be removed without any tool for the maintenance such as cleaning inside of the shoot 6, thereby improving the operability.

The shoot 6 diagonally extends toward the front lower direction to face the fixing portion 5A on the front face of the lower door 5, and the outlet 6A at the lower end thereof is opened toward the inside of the filling portion 5A. A detachable cover 26 is provided in front of the outlet 6A of the shoot 6 so that the outlet 6A can be freely opened/closed by this cover 26. Reference character 6D denotes a slit into which the cover 26 is inserted in the drawing. Moreover, a shoot sensor 116 consisting of a magnet switch is attached to the lower surface of the shoot 6 which serves as the upper side of the cover 26. This shoot sensor 116 detects. opening/closing of the cover 26 by a magnet (not shown) provided at the lower end of the cover 26.

Incidentally, although the shoot 6 is formed rather thick in order to increase its capacity, an inclined surface 6C is formed on the lower surface of its end so that shoot 6 is tapered from the both sides. This makes such an arrangement as that the solid preparation can be filled in a container V without dropping the medicine even if the opening of the later-described container V is small. Further, the outlet 21B of the holding cell 21 in the holding unit 61 and the shutter 17 moved to the front central portion of the base plate 24 as described above are matched with the upper side of the upper end inlet 6B of the shoot 6.

Further, in FIG. 4, reference numerals 117 and 118 denote an upper door sensor and a lower door sensor (each of which is composed of a micro switch and others) for detecting opening/closing of the upper door 4 and the lower door 5. Moreover, a rack plate 119 which is opened in the horizontal direction is disposed to the rail 59 or the lower surface of the base plate 24, and an electric substrate 121 is accommodated in the rack plate 119 so as to be capable of sliding in the horizontal direction so that it can be freely pulled out together with the lower door 5. Therefore, when the lower door 5 is pulled out to draw the electric substrate 121 in the lateral direction, the maintenance can be facilitated.

Figure 37:
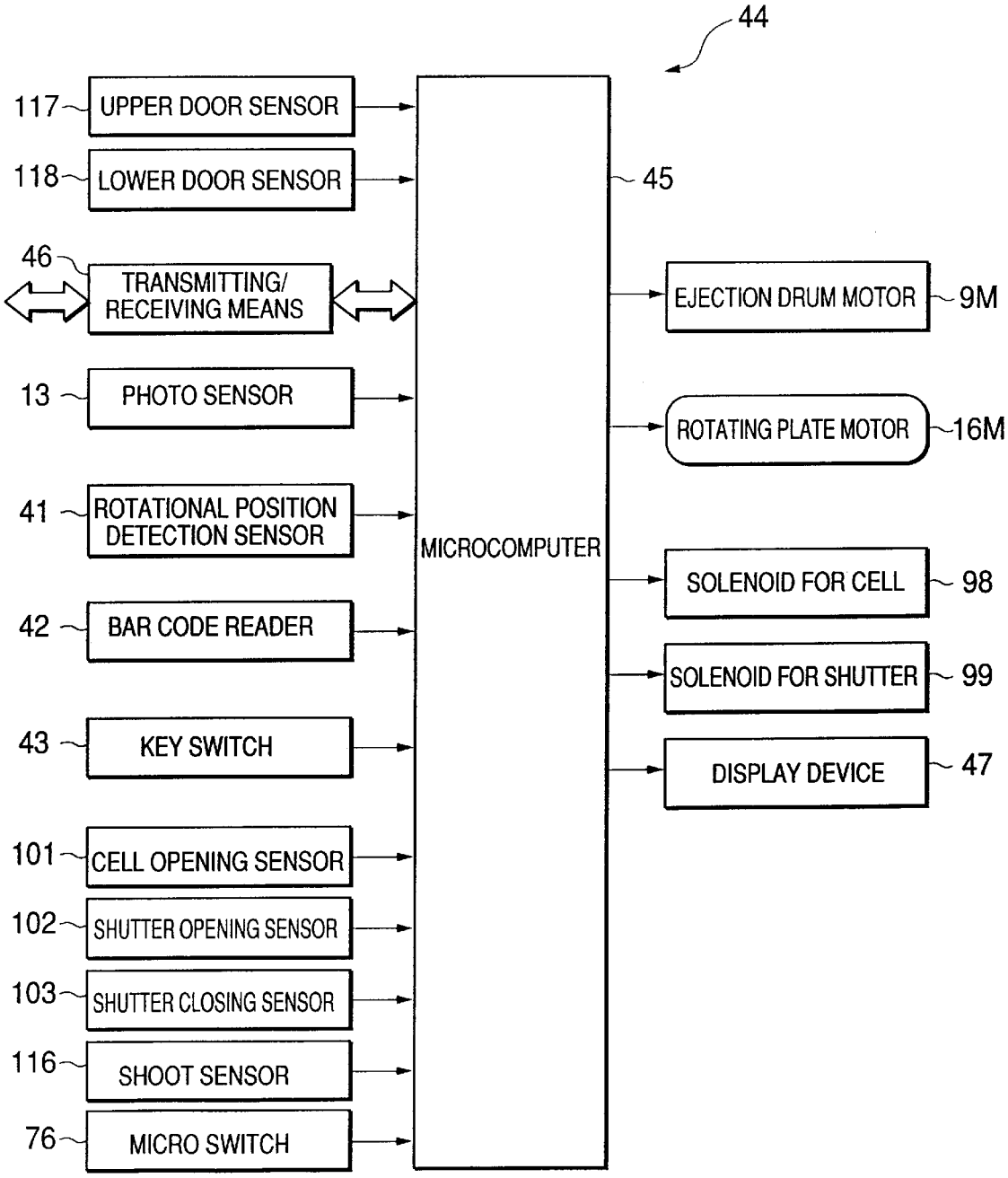
FIG. 37 is a block diagram showing a control device of the solid preparation filling apparatus according to the present invention.

FIG. 37 is a block diagram showing the control device 44 of the solid preparation filling apparatus 1 according to the present invention. The control device 44 is constituted by a general-purpose microcomputer 45, and to the microcomputer 45 is connected transmitting/receiving means 46 for performing transmission/reception of data with an external personal computer and the like. Further, to the input terminal of the same are connected a photo sensor 13 of the ejection count device 8, the rotational position detection sensor 41 for detecting a rotational position of the rotating plate 16, the cell opening sensor 101, the shutter opening sensor 102, the shutter closing sensor 103, the shoot sensor 106, the micro switch 76 (whose actual number is four), the upper door sensor 117, the lower door sensor 118, a bar code reader 42 and a key switch 43.

Moreover, to the output terminal of the microcomputer 45 are connected an ejection drum motor 9M for rotating the ejection drum 9 of the ejection count apparatus 8, the rotating plate motor 16M, the solenoid 98 for a cell and a solenoid 99 for a shutter in the solenoid unit 27, and the display device 47.

Figure 38:
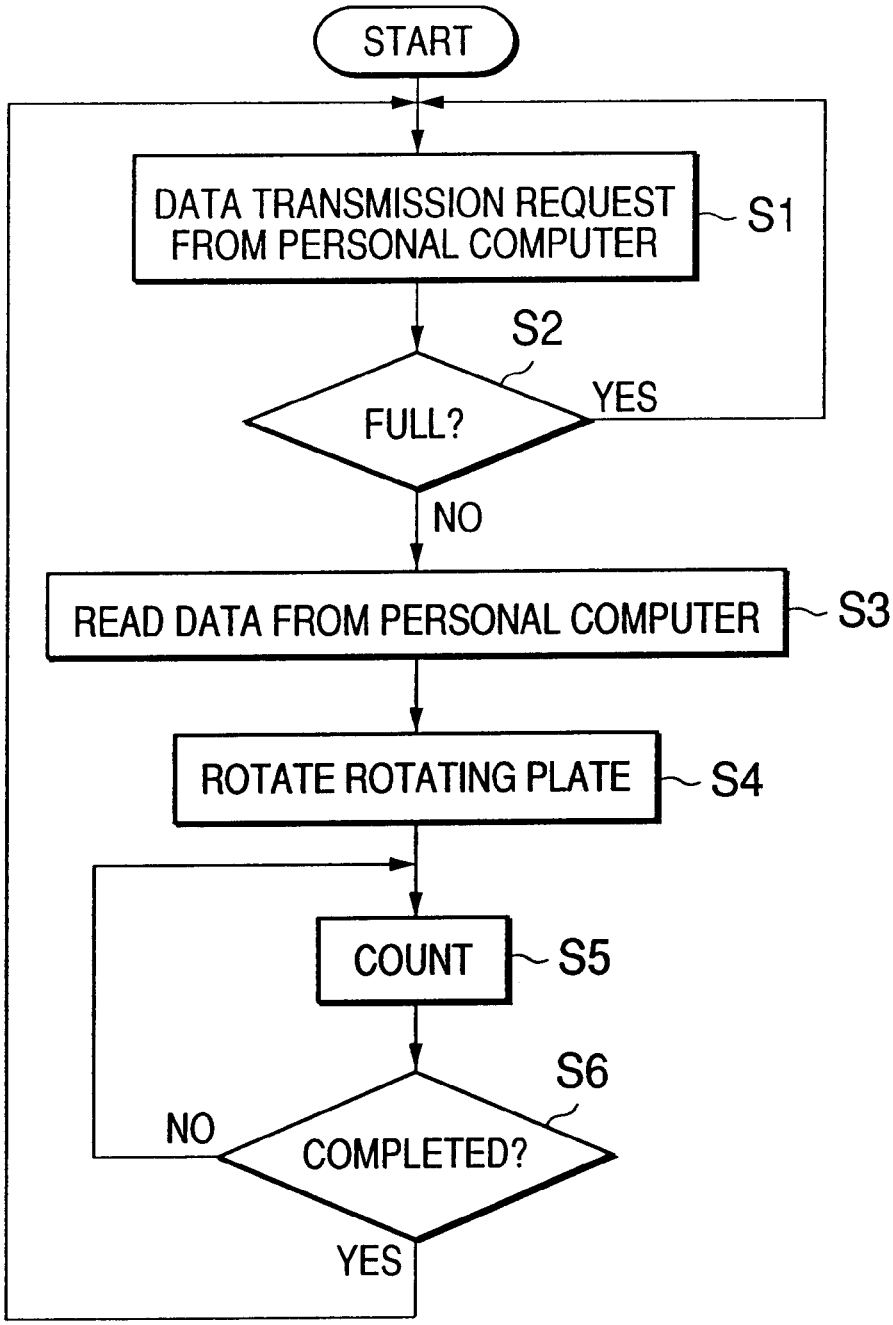
FIG. 38 is a flowchart showing a program of a microcomputer of the solid preparation filling apparatus according to the present invention.
Figure 39:
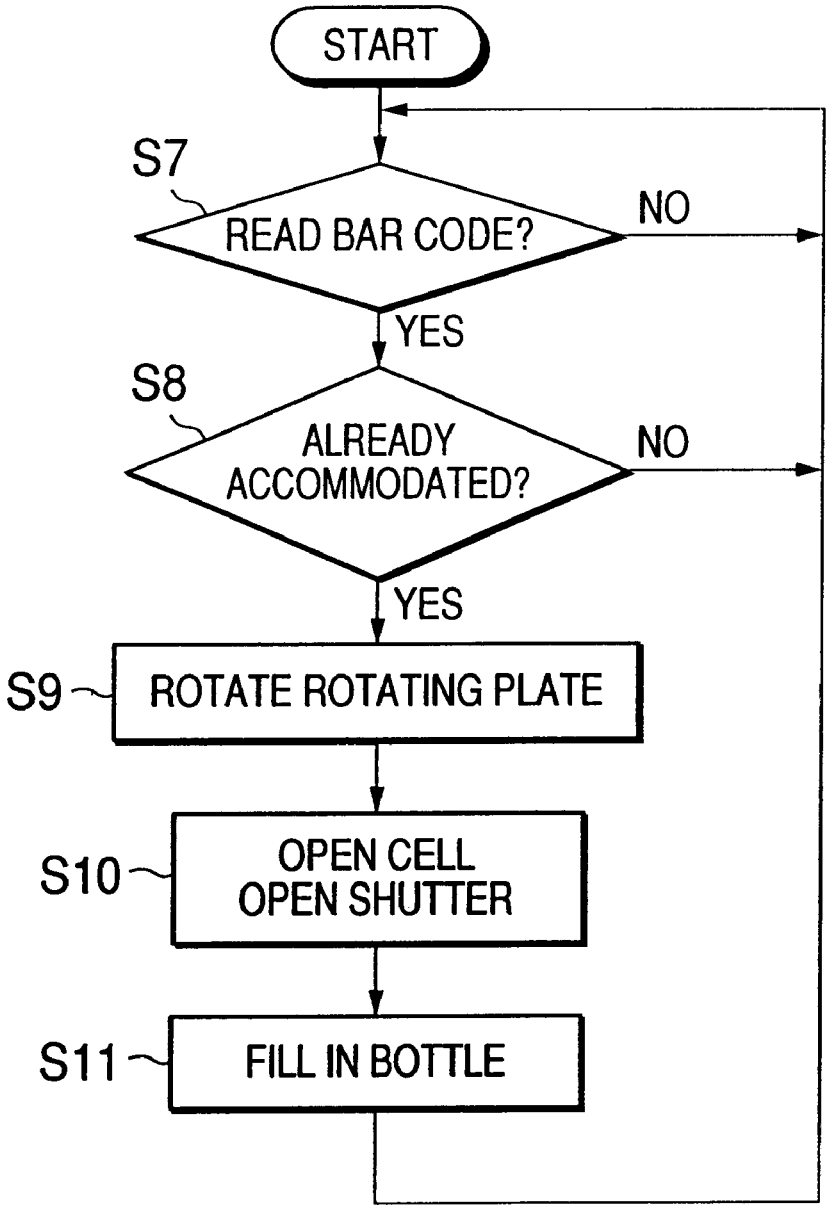
FIG. 39 is another flowchart showing the program of the microcomputer of the solid preparation filling apparatus according to the present invention.

Description will now be given as to the operation of the solid preparation filling apparatus 1 according to the present invention having such an arrangement. FIG. 38 is a flowchart of a program for effecting the solid preparation ejection operation of the microcomputer 45, and FIG. 39 is a flowchart of a program for executing the solid preparation filling operation of the microcomputer 45.

Figure 30:
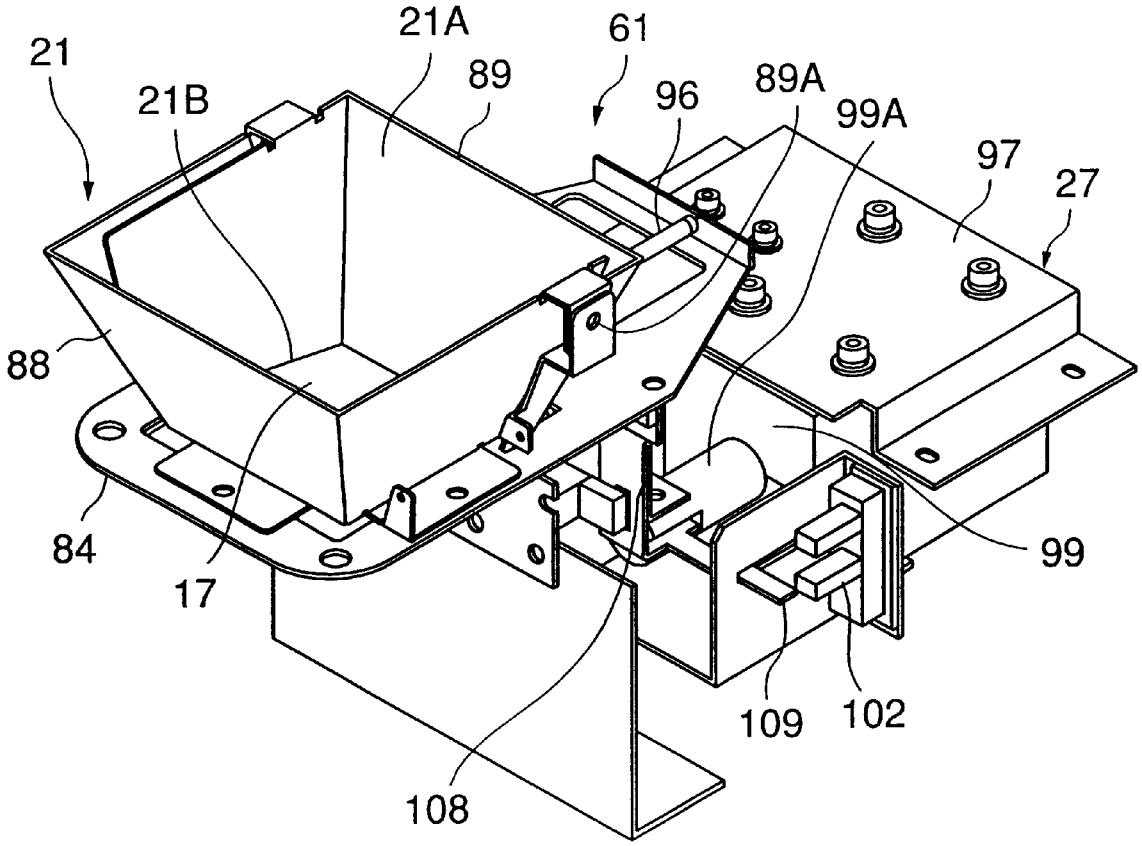
FIG. 30 is a perspective view of the holding unit and the solenoid unit of the solid preparation filling apparatus according to the present invention, with the shutter being closed.

It is to be noted the shutter 17 of each holding unit 61 closes the outlet 21B of the holding cell 21 and the movable cell 89 also narrows the outlet 21B when the power supply is turned on (FIGS. 30, 31 and 32). Also, each count value and the like is reset.

The microcomputer 45 uses the rotating plate motor 16M to rotate the rotating plate 16 in, for example, the clockwise direction in the drawing. When it is detected that the notches 81 and 79B have reached the positions directly above the detection terminals 41A and 41B of the rotational position detection sensor 41 (detection is attained when the both terminals detect the light), rotation is continued so that the rotating plate 16 is rotated 8° in terms of the rotational angle of the rotating plate 16. This causes the rotating plate 16 to enter the state shown in FIG. 16 and it is stopped when the notch 79A has reached the position above the detection terminal 41A.

This state is an initial position of the rotating plate 16, and the microcomputer 45 recognizes the respective positions of all the holding units 61 (for example, 10 units No. 1 to No. 10) based on the arrangement of the 10 openings 82 (arranged at 36° intervals in terms of the rotational angle of the rotating plate 16). Now the initial setting is completed.

Further, the microcomputer 45 stores therein information of positions of the outlets 12 of the respective tablet cases 7 and those of the discharge ports 51A of the respective hoppers 51 to 54 provided under the former members in corresponding manner and calculates the rotational angle (including 0 degree) of the rotating plate 16 for moving the holding cell 21 of a predetermined holding unit 61 on the lower side of the discharge port 51A, 52A, 53A or 54A of the hopper 51, 52, 53 or 54 positioned below a predetermined tablet case 7 based on the stored information.

When an operator inputs prescription data to the personal computer based on a medical prescription of a physician, the personal computer issues a data transmission request to the solid preparation filling apparatus 1. When the microcomputer 45 of the solid preparation filling apparatus 1 receives the data transmission request from the personal computer by transmitting/receiving means 46 in the step S1, a judgment is made upon whether the solid preparation is fully reserved in the holding cells 21 of all the holding units 61 of the rotating plate 16 in the step S2. If the holding cells 21 are full, the control returns to the step S1 and enters the standby mode.

If the all the holding cells 21 are not full in the step S2, the microcomputer 45 sends a replay indicating that it is in the standby mode to the personal computer in the step S3, and accordingly receives and reads the prescription data sent from the personal computer. Based on the prescription data, the microcomputer 45 recognizes the position of a tablet case 7 for accommodating therein a solid preparation whose type is designated by the prescription data.

Subsequently, the microcomputer 45 recognizes the vacant holding cell 21 (holding unit 61) and its position in the step S4 and, if the holding cell 21 of the holding unit 61 No. 1 is empty for example, the rotational angle is calculated as described above. Further, the rotating plate motor 16M is driven to rotate the rotating plate 16 so that the upper end inlet 21A of the holding cell 21 of the holding unit 61 No. 1 moves to the lower side of the discharge port 51A, 52A, 53A or 54A of the hopper 51, 52, 53 or 54 positioned below the outlet 12 of the recognized tablet case 7 in the corresponding manner. The position of the holding unit 61 is adjusted and its number is stored.

If there is the empty holding cell 21 (holding unit 61) by accident below the discharge ports 51A to 54A or the hoppers 51 to 54, the microcomputer 45 does not rotate the rotating plate 16 but stores the number of this holding cell 21.

Then, the microcomputer 45 drives to rotate the discharge drum motor 9M of the discharge count device 8 of the recognized tablet case 7 in the step S5. This causes the discharge drum 9 to rotate, and the solid preparations fall one by one. However, the falling solid preparation is caught in the hopper 51, 52, 53 or 54 positioned below the solid preparation and further falls to be received in the holding cell 21 of the holding unit 61 from the discharge port 51A, 52A, 53A or 54A.

A number of falling solid preparations is counted by the microcomputer 45 using the photo sensor 13. A judgment is made upon whether the count is completed in the step S6 and, if no, the control returns to the step S5 to repeat this operation. If a number of fallen solid preparations detected by the photo sensor 13 coincides with a number of preparations based on the prescription data, the microcomputer 45 determines that the count is completed and stops rotation of the discharge drum motor 9M, thereby returning to the step S1.

On the other hand, the solid preparation which has fallen in the holding cell 21 (for example, No. 1) reaches the lower portion of the holding cell 21, but the opening 21B at the lower end is closed by the shutter 17, and the solid preparation is therefore temporarily reserved in the holding cell 21. The microcomputer 45 repeats the operations from the step S4 to the step S6 on all types of the solid preparations designated by the prescription data and puts them in the holding cells 21 of the different holding units 61 in accordance with the respective types.

This can cause up to 10 kinds of solid preparations to be reserved in the holding cell 21 in each holding unit 61. Incidentally, although the solid preparations are sequentially housed in the holding cells 21 in accordance with each type in the above embodiment, since the four hoppers 51 to 54 are used in the embodiment, it is possible to effect such a parallel operation as that the four types of the solid preparations can be caused to fall from the tablet cases 7 above the respective hoppers 51 to 54 to be simultaneously housed in the different holding cells 21 by associating the empty holding cells 21 to the discharge ports 51A to 54A of all the hoppers 51 to 54. This configuration can further shorten the filling time.

In order to simultaneously use all the hoppers 51 to 54 in parallel, positioning with the holding cell 21 is important. Therefore, when the discharge ports 51A to 54A of the four hoppers 51 to 54 are arranged at 90° intervals with respect to the rotational center 16A, the holding cells 21 must be also arranged at 90° intervals for the accurate positioning. Therefore, the holding units 61 whose quantity is a multiple number of four are arranged at the equal intervals.

On the other hand, the operator attaches a bar code label, on which a bar code indicative of one type of the solid preparations designated by the prescription data is printed, on the side surface of a predetermined container V (for example, a bottle). When the bar code label is inserted into the filling portion 5A of the solid preparation filling apparatus 1, the bar code on the bar code label is read by the bar code reader 42.

The microcomputer 45 judges on whether the bar code (type of the solid preparation) read by the bar code reader 42 is fetched and, if it is fetched, the control advances to the step S8 where a judgment is made upon whether this type of the solid preparation has been accommodated in the holding cell 21 (No. of this holding unit 61 is stored as described above). If it has not been accommodated, the control returns to the step S7 to enter the standby mode.

When this type of the solid preparation is accommodated in the holding cell 21 of the holding unit 61 in the step S6, the microcomputer 45 advances from the step S8 to the step S9. Then, the holding unit 61 in which the solenoid preparation is housed is selected based on the stored No.; the rotating plate motor 16M is driven to rotate the rotating plate 16; and the holding unit 61 is set at the position of the shoot 6 at the front central portion of the base plate 24 and the solenoid unit 27 based on the fact that the rotation step of the motor and the rotational position detection sensor 41 detect the notch 79.

In this state, the driving plates 106 and 108 of the solenoid unit 27 are respectively positioned on the front side of the operating plates 92 and 94 of the holding unit 61 as shown in FIG. 26. Then, the microcomputer 45 energizes the solenoid 98 for a cell and the solenoid 99 for a shutter in the step S10 and moves the movable cell 89 in order to open the outlet 21B and the shutter 17.

The movement of the movable cell 89 and the opening of the shutter 17 are detected by the cell opening sensor 101 and the shutter opening sensor 102 from the pullback of the sensing plates 107 and 109 and inputted in the microcomputer 45. The opening of the shutter 17 causes the solid preparation in the holding cell 21 to fall from the outlet 21B at the lower end into the shoot 6. At this time, since the outlet 6A of the shoot 6 is closed by the cover 26, the solid preparation is reserved in the shoot 6.

Since the microcomputer 45 de-energizes the solenoid 98 for a cell and the solenoid 99 for a shutter after the lapse of a predetermined period of time from the energization, the movable cell 89 is moved and returned by the spring 91 in a direction for narrowing the outlet 21B, and the shutter 17 is also swiveled by the spring 96 to again close the outlet 21B (horizontal state).

Here, a plurality of the solid preparations fallen from the hoppers 51 to 54 into the holding cells 21 are piled and jammed to form a so-called bridge in the holding cell 21. Although only the solid preparations presented at the lower portion may fall even if the shutter 17 is opened, since the movable cell 89 is moved to open the outlet 21B, this bridge is broken so that the solid preparations can be caused to assuredly fall into the shoot 6 at the earlier stage.

Although the solid preparations fall into the shoot 6 in this manner, since the shoot 6 is formed thick, it has a sufficient capacity to reserve the solid preparations. In addition, since the shoot 6 is a transparent cylinder, a dispenser can be aware of that the solid medicines are prepared. In this state, when the opening portion of the container V is applied under the outlet 6A of the shoot 6 and the cover 26 is manually opened, the specific type of the solid preparation can be filled in the bottle from the shoot 6. The opening/closing of the cover 26 is detected by the shoot sensor 116 and outputted to the microcomputer 45 (step S1).

Additionally, since the holding cell 21 and the shutter 17 are integrated to constitute the holding unit 61 as described above and this unit is mounted on the rotating plate 16 and fixed by the snap type fixture 100, the assembling operability is extremely improved. Further, since the solenoid unit 27 having the solenoids 99 and 98 for operating the movable cell 89 or the shutter 17 is provided and operates the unit matched with the shoot 6 without interfering movement of the holding unit 61 involved by rotation of the rotating plate 16, only the single solenoid unit 27 suffices the operation, and reduction in a number of components can be prominently achieved as compared with the case where the solenoid is attached to each holding unit 61.

Incidentally, when the microcomputer 45 detects opening of the upper door 4 or the lower door 5 by the upper door sensor 117 or the lower door sensor 118, it interrupts the dispensing operation. The dispensing operation is continued from the moment of closure.

When the microcomputer 45 detects from the micro switch 76 that any one of the hoppers 51 to 54 is not attached, it prohibits the dispensing operation and displays a warning of prohibition on the display device 47.

Moreover, when cell opening sensor 101 can not detect the movement of the movable cell 89 in the dispensing operation, when the shutter opening sensor 102 can not detect the opening of the shutter 17, or when the shutter closing sensor 103 can not detect the closure of the shutter 17 (no light reflection), the dispensing operation is prohibited and a warning of prohibition is displayed on the display device 47.

In addition, when the shoot sensor 116 does not detect the opening/closing of the cover 26, at least the opening of the shutter 17 is prohibited. This can avoid such an inconvenience as that any solid preparation falls in the shoot 6 with the other solid preparation being reserved in the shoot 6.

In this manner, according to the present invention, since the solid preparations are ejected by the microcomputer 45 from the tablet case 7 accommodating therein the solid preparations in accordance with each type and the solid preparations ejected from the tablet case 7 are received in a plurality of hoppers 51 to 54 aligned on the lower side, the vertical dimension of the apparatus can be reduced while maintaining the inclination angle of the hoppers 51 to 54 into which the solid preparations can fall.

Further, since the microcomputer 45 associates the inlet 21 at the upper end of the holding cell 21 with the discharge ports 51A to 54A of the hoppers 51 to 54 for receiving the ejected solid preparation by rotating and moving the holding unit 61 so as to adjust its position, the solid preparation falling from the tablet case 7 is temporarily housed in a predetermined holding cell 21. When filling the solid preparation in the container V, the holding unit 61 is rotated and moved so that its outlet 21B is matched with the shoot 6, and the movable cell 89 is moved to open the shutter 17. The solid preparation in the holding cell 21 therefore smoothly enters the shoot 6 from the outlet 21B at the lower end, and hence the solid preparation can be guided to be filled in the container V.

Thus, each solid preparation designated from multiple types of solid preparations can be filled in the container V by using one shoot 6, which greatly improves the operability. Since the operation is realized such that the upper end inlet 21A of the holding cell 21 is associated with the discharge ports 51A to 54A of the hoppers 51 to 54 and the lower end outlet 21B of the holding cell 21 is associated with the shoot 6 by rotating and moving the holding unit 61, the time required for filling can be largely shortened, and the waiting time until the solid preparation is provided to a patient can be further reduced to improve the service.

Moreover, when, for example, continuously filling multiple types of solid preparations, since the solid preparations can be accommodated in the plural holding cells 21, thereby smoothing the parallel processing. In particular, since mixture of the solid preparations can be assuredly avoided if positioning of the hoppers 51 to 54 and the holding cell 21 is secured, it is no longer necessary to strictly manage the clearance between the driven components and the peripheral members thereof and the like as compared with the prior art, thus realizing simplification of the structure and reduction in the manufacturing cost.

Additionally, since the cover 26 which can be opened/closed without restraint is provided at the outlet 6A of the shoot 6, the solid preparation can be reserved in the shoot 6 after the shutter 17 is opened to eject the solid preparation from the holding cell 21 to the shoot 6 until the operator opens the cover 26. Therefore, the operation for filling the medicine into the capacitor V can be further assured and facilitated.

Although the description has been given as to the structure by which the operation is effected based on the prescription data from the host computer in this embodiment, the present invention is not restricted thereto, and it is also effective if the standalone usage is adopted such that the prescription data is inputted by the key switch 43.

Further, although the solid preparation is taken out from one tablet case 7 in this embodiment, the present application is not restricted to thereto. As described above, the same solid preparations may be housed in two or more tablet cases 7 positioned above the same hopper 51, 52, 53 or 54 in order to cause the solid preparations to simultaneously fall from these tablet cases 7. In such a case, the microcomputer 45 rotates the ejection drum motor 9M corresponding to these tablet cases 7 and counts a number of preparations based on a signal from the photo sensor 13 associated with the plural tablet cases 7. It is to be noted that the timings for causing the solid preparations in the multiple tablet cases to fall are staggered by controlling rotation of the ejection drum motor 9M corresponding to the plural tablet cases 7 in order to prevent the solid preparations from simultaneously falling.

Moreover, the container V is not restricted to a bottle in this embodiment, and a package bag made of resin or paper may be used as the container to fill the solid preparation therein.

According to the present invention, since the solid preparations are ejected from the tablet cases for accommodating therein the solid preparations in accordance with each type and the solid preparations ejected from the tablet cases can be received in the multiple hoppers aligned under the tablet cases, the vertical dimension of the apparatus can be reduced while maintaining the inclination angle of the hoppers into which the solid preparation can fall.

Since the upper end inlet of the holding cell is associated with the discharge port of the hopper which receives the ejected solid preparation by rotating and moving the holding cell to adjust the position thereof, the solid preparation falling from the tablet case can be temporarily housed in a predetermined holding cell. When filling the solid preparation in the container, the holding cell is rotated and moved so that its outlet is matched with the filling means in order to open the shutter. The solid preparation in the holding cell is then guided and filled in the container from the lower end outlet by the filling means.

Therefore, each solid preparation designated from the plural kinds of solid preparations can be filled in the container by one filling means, which can prominently improve the operability. Further, since the operation is realized such that the upper end inlet of the holding cell is associated with the discharge port of the hopper by rotating and moving the holding cell and the lower end outlet of the holding cell is matched with the filling means, the time required for filling can be greatly reduced and the waiting time until the solid preparation is provided to a patient can be further shortened, thereby improving the service.

Additionally, in the cases where, for example, a plurality of kinds of solid preparations are continuously filled, since the respective solid preparations can be housed in the multiple holding cells, the parallel processing can be smoothly carried out. In particular, since mixture of the solid preparations can be assuredly avoided if positioning of the hopper and the holding cell can be securely performed, it is no longer necessary to strictly manage the clearance between the driven components and the peripheral members as compared with the prior art, thus realizing simplification of the structure and reduction in the production cost.

In the present invention in particular, since the holding cell and the shutter constitute the holding unit and the multiple holding units are mounted on the rotating plate which rotates under the hopper, the time and the labor required for assembling the holding cell or the shutter can be eliminated, which enables the great improvement of the assembling operability.

Furthermore, the shutter driving means for opening/closing the shutter is disposed without interfering rotation and movement of the holding unit caused due to rotation of the rotating plate so that the holding cell can be freely engaged with the shutter of the holding unit matched with the filling means, a single shutter driving means for opening/closing the shutters of the multiple holding units can suffice the apparatus, and a number of components can be largely reduced as compared with the case where the driving means is provided to each holding unit.

In addition, the shutter opening/closing detecting means for detecting opening/closing of the shutter is provided, and hence it is possible to detect a failure generated in opening/closing of the shutter due to a defect of the shutter driving means or any other member when this occurs. Further, operation of the apparatus and the like can be prohibited or an alarm can be generated.

Since the cover which can be opened/closed without restraint is provided to the outlet of the shoot which serves as guiding means, after the shutter is opened to eject the solid preparation from the holding cell to the guide portion, the solid preparation can be reserved in the guide portion until the operation opens the cover. Thus, the operation for filling the solid preparation into the container can be assured and facilitated.

Figure 40:
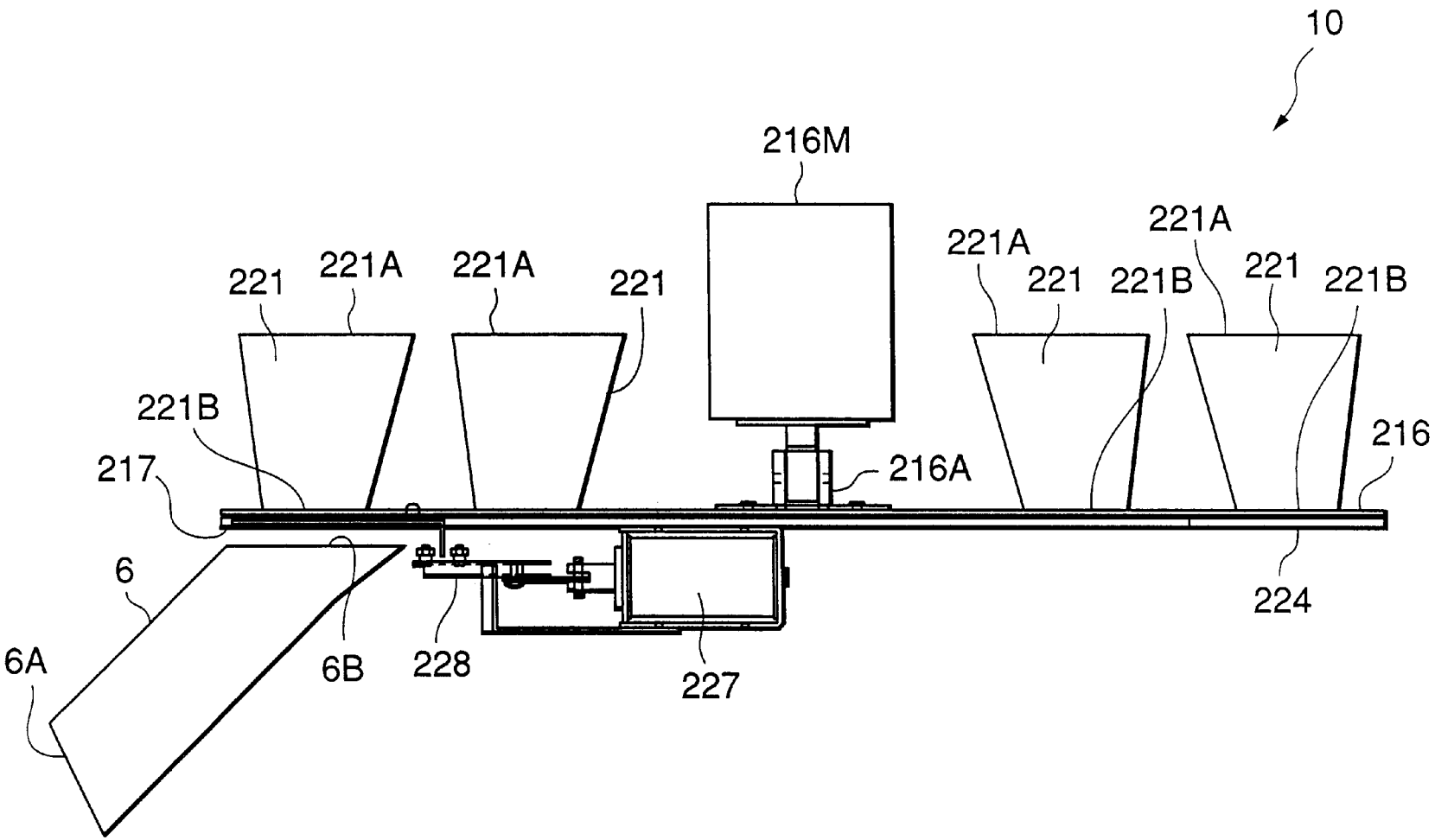
FIG. 40 is a plan view showing the internal structure of a solid preparation filling apparatus according to another embodiment of the present invention.
Figure 41:
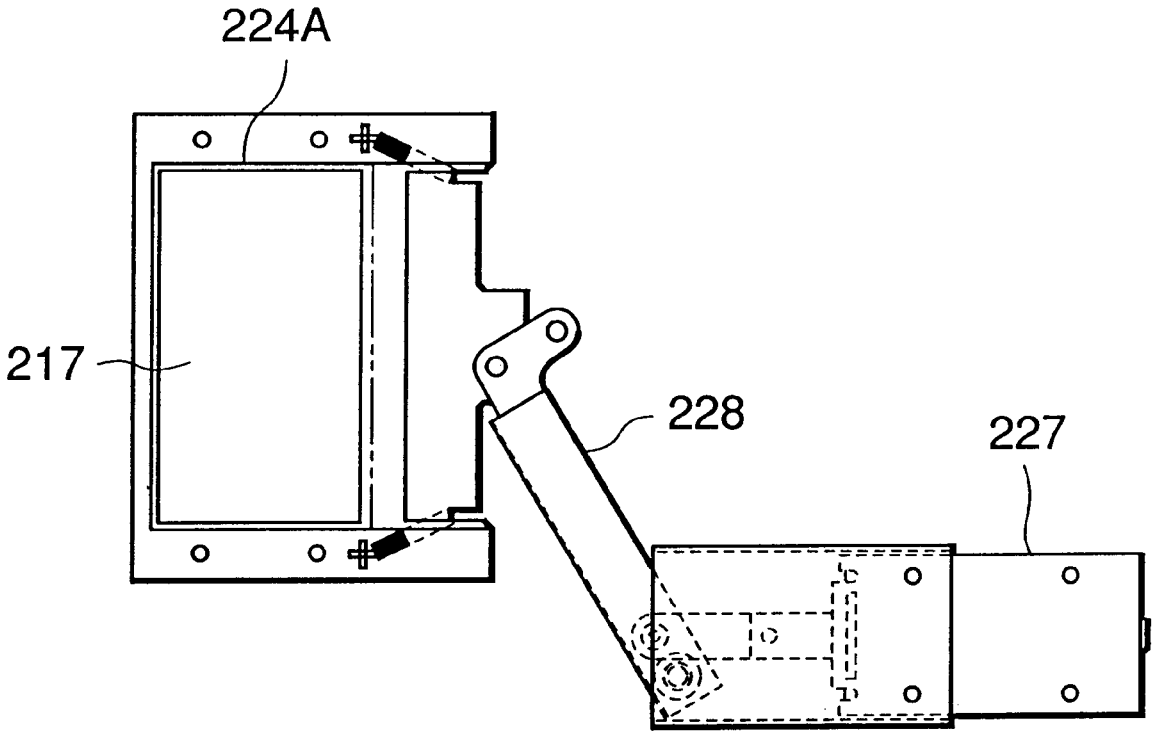
FIG. 41 is a plan view showing a shutter of the solid preparation filling apparatus depicted in FIG. 41.

Description will now be given as to a solid preparation filling apparatus according to another embodiment of the present invention with reference to FIGS. 40 and 41. FIG. 40 shows a solid preparation filling mechanism 10 of the solid preparation filling apparatus in this example, and to the periphery of a rotating plate 216 constituting the solid preparation filling mechanism 10 in this example are provided 10 holding cells 221 in total in this embodiment. Each holding cell 221 includes an inlet 221A at the upper end and an outlet 221B at the lower end on the rotating plate 216 and has a container-like shape in which the lower end is narrowed, the respective holding cells being arranged at predetermined intervals on one circumference around a rotational center 216A of the rotating plate 216.

Here, discharge ports 51A to 54A of hoppers 51 to 54 such as described in the foregoing embodiment are arranged on one circumference, and this circumference is matched with the upper part of the circumference on which the holding cells 22 are provided. Further, the inlets 221A of the respective holding cells 221 are positioned directly below the respective discharge ports 51A to 54A. That is, rotation of the rotating plate 216 causes the inlets 221A of the holding cells 221 to rotate and move on the circumference on which the discharge ports 51A to 54A of the hoppers 51 to 54 are provided.

A rotating plate motor 216M made up of a step motor and the like is provided on the upper side of the rotational center 216A of the rotating plate 216, and a rotational axis of the rotating plate motor 216M is fixed on the top face of the rotational center 216A. The rotating plate motor 216M rotates and moves the rotating plate 216.

A base plate 224 is provided on the lower side of the rotating plate 216, and a rectangular through hole 224A is formed at the center of the front portion of the base plate 224. The rotating plate 216 rotates on the base plate 224, and this rotation causes the outlet 221B at the lower end of each holding cell 221 to be alternatively matched with the through hole 224A and another outlet 221B at the lower end to be closed by the base plate 224.

A shoot 6 which is similar to that in the above embodiment has a cylindrical shape, and its inlet 6B at the upper end is opened on the lower side of the through hole 224A of the base plate 224. The shoot 6 diagonally extends to the front lower side to face a filling portion 5A on the front face of a lower door 5 as described above, and its outlet 6A at the lower end is opened to the inside of the filling portion 5A. A detachable cover 26 is similarly attached to the front side of the outlet 6A of the shoot 6, and the cover 26 enables opening/closing of the outlet 6A without restraint.

The shutter 217 is provided to the through hole 224A of the base plate 224 so as to be capable of moving in the horizontal direction. The shutter 217 is moved in the front-and-back direction by a shutter opening/closing solenoid 227 similarly disposed to the base plate 224 and a link mechanism 228 so that the inlet 6B of the shoot 6 positioned on the lower side is opened/closed.

With the above-described configuration, when the solid preparation is housed in the holding cell 221 as similar to the above, the microcomputer 45 selects the holding cell 221 containing the solid preparation therein based on No. stored in the microcomputer 45, and drives the rotating plate motor 216M to rotate the rotating plate 216. Further, the microcomputer 45 sets the holding cell 221 at a position of the through hole 224 (shutter 217) based on a rotational position detection sensor.

In this state, the outlet 221B at the lower end of the holding cell 221 is matched with the through hole 224 and the inlet 6B of the shoot 6 is matched with the same on the lower side with the shutter 217 therebetween. Next, the microcomputer 45 energizes the shutter opening/closing solenoid 227 to move the shutter 217 via the link mechanism 228 in the horizontal direction in order to open the through hole 224A.

When the shutter 217 is opened, the solid preparation in the holding cell 221 is caused to fall in the shoot 6 from the lower end outlet 221B. The subsequent operation is similar to that described above.

According to this structure, since the shutter is used to open/close the inlet of the guide portion, opening/closing means such as a shutter does not have to be provided to the lower end outlet of each holding cell, thereby enabling simplification of the structure.

What is claimed is:

1. A solid preparation dispensing and filling apparatus comprising:

a plurality of tablet cases each for holding therein a respective type of solid preparation to be dispensed;

a plurality of hoppers each having an inlet and a discharge port, the inlet of each of said hoppers located below a respective group of said tablet cases to receive the preparations dispensed therefrom;

a rotatable plate having a plurality of holding cells mounted thereon, each said holding cell having an inlet to be positioned below the discharge of each of said plurality of hoppers as said plate is rotated, an outlet, and a shutter normally closing said holding cell outlet;

a guide portion having an inlet positioned below said rotating plate and an outlet from which the preparation is dispensed from the apparatus for falling into a container; and means for opening said shutter of a said holding cell holding a preparation therein when said holding cell has its outlet positioned above said guide portion inlet.

2. A solid preparation dispensing and filling apparatus as claimed in claim 1 further comprising control means for:

ejecting a solid preparation from a selected tablet case into the inlet of the hopper located below the discharge port of said selected tablet case with the solid preparation being dispensed from the discharge port of said hopper into the inlet of a respective holding cell, and rotating said plate to bring said holding cell holding the solid preparation to have its outlet aligned with said inlet of said guide portion.

3. A solid preparation dispensing and filling apparatus as claimed in claim 1 wherein a said holding cell and its shutter comprises a holding unit, a plurality of said holding units arranged in a circle on said rotable plate.

4. A solid preparation dispensing and filling apparatus as claimed in claim 1 wherein said plurality of tablet cases are arranged in a rectangular grid and the inlet of each of said hoppers is under the outlets of the tablet cases of a section of said grid that comprises a portion of said plurality of said tablet cases.

5. A solid preparation dispensing and filling apparatus as claimed in claim 1 further comprising means for detecting the opening/closing of a said shutter of a holding cell.

6. A solid preparation dispensing and filling apparatus as claimed in claim 1 further comprising a cover for opening/closing said outlet of said guide portion.

7. A solid preparation dispensing and filling apparatus as claimed in claim 1 wherein the inlet of each of said plurality of holding cells can be rotated to and selectively portioned under the discharge port of each of said plurality of hoppers.

* * * * *